US012369678B1

(12) United States Patent
Smyser et al.

(10) Patent No.: US 12,369,678 B1
(45) Date of Patent: Jul. 29, 2025

(54) SHOE WITH ENHANCED FOOT AND ANKLE SUPPORT

(71) Applicants: Ezra John Smyser, Brooklyn, NY (US); Alexander Brian Morel, Brooklyn, NY (US)

(72) Inventors: Ezra John Smyser, Brooklyn, NY (US); Alexander Brian Morel, Brooklyn, NY (US)

( * ) Notice: Subject to any disclaimer, the term of this patent is extended or adjusted under 35 U.S.C. 154(b) by 0 days.

(21) Appl. No.: 18/423,142

(22) Filed: Jan. 25, 2024

(51) Int. Cl.

| | |
|---|---|
| ***A43B 7/20*** | (2006.01) |
| ***A43B 5/00*** | (2022.01) |
| ***A43B 7/1425*** | (2022.01) |
| ***A43B 17/02*** | (2006.01) |
| ***A43C 11/14*** | (2006.01) |
| ***A43C 11/20*** | (2006.01) |

(52) U.S. Cl.
CPC ..... *A43B 7/20* (2013.01); *A43B 5/00* (2013.01); *A43B 7/1425* (2013.01); *A43B 17/02* (2013.01); *A43C 11/14* (2013.01)

(58) Field of Classification Search
None
See application file for complete search history.

(56) References Cited

U.S. PATENT DOCUMENTS 892,152 A * 6/1908 Harman ..... A43B 7/32 36/108
4,640,025 A * 2/1987 DeRenzo ..... A43C 11/1493 36/114
4,811,498 A * 3/1989 Barret ..... A43B 5/0411 36/117.7
4,922,630 A 5/1990 Robinson
5,269,078 A * 12/1993 Cochrane ..... A43B 7/22 36/170
5,771,608 A 6/1998 Peterson
5,819,439 A * 10/1998 Sanchez ..... A43C 11/14 36/89
6,272,772 B1 * 8/2001 Sherman ..... A43C 11/14 36/89
6,772,541 B1 * 8/2004 Ritter ..... A43B 7/22 36/91
6,775,929 B2 * 8/2004 Katz ..... A43C 11/14 36/114
9,532,625 B2 * 1/2017 Katz ..... A43B 13/145
(Continued)

*Primary Examiner* — Jila M Mohandesi
(74) *Attorney, Agent, or Firm* — Aaron L. J. Pereira

(57) ABSTRACT

The present disclosure is directed to a shoe that provides support and protection to the ankle of a wearer and prevents or impedes displacement of the ankle ligaments during athletic movements. The shoe may comprise two or more of the following: an upper comprising a medial sidewall and lateral sidewall; a first strap attached to the lateral sidewall of the shoe; a second strap attached to the medial sidewall of the shoe; an outsole; two or more outriggers disposed on the lateral side of the shoe proximal to the outsole; an insole comprising a deep heel cup; an internal heel counter; an external heel counter; an external heel support portion on the outsole; a midfoot webbing; laces; a tongue comprising a loop to help secure and position the straps; an inner heel channel to position and cushion the straps and to support and protect the ankle of the wearer; and one or more slits or opening in the lateral sidewall through which one or more of the straps may emerge and be positioned for engagement.

20 Claims, 17 Drawing Sheets

(56) References Cited

U.S. PATENT DOCUMENTS

| | | | | |
|---|---|---|---|---|
| 10,299,540 | B2 * | 5/2019 | Bishop | A43C 11/1493 |
| 11,000,098 | B2 * | 5/2021 | Fogg | A43C 11/1493 |
| 11,617,420 | B2 * | 4/2023 | Maselino | A43B 11/00 36/45 |
| 12,225,981 | B2 * | 2/2025 | Bartels | A43C 11/1493 |
| 2009/0071037 | A1 * | 3/2009 | Foxen | A43B 7/20 36/89 |
| 2016/0270484 | A1 * | 9/2016 | Zadnik | A43C 1/06 |
| 2016/0302515 | A1 * | 10/2016 | Xanthos | A43B 13/14 |
| 2017/0071774 | A1 * | 3/2017 | Ostergard | A43C 1/00 |
| 2020/0205515 | A1 * | 7/2020 | Cross | A43B 13/14 |

* cited by examiner

SHOE WITH ENHANCED FOOT AND ANKLE SUPPORT

BACKGROUND

The present invention relates to shoes, specifically to shoes designed to enhance lateral support and reduce the risk of ankle injury with an integrated fit system.

To the extent that any statement herein refers to anything other than the present disclosure and/or present invention, such statements are merely descriptive of the background and field of the invention and are not admissions that anything is prior art to the present invention. To the extent that the inventor characterizes anything that came before the present invention, such characterization is made through the unique lens of the inventor and may include knowledge of the present invention, such that any characterization of alleged prior art is not an admission that any feature was taught in the prior art or is or is not present in the inventor's disclosure.

The mechanics of ankle injuries is an evolving area of research. The structure of the invention disclosed in the present application takes into account the corpus of literature including recent research on ankle injuries and preventions, and seeks to incorporate key learnings into the novel and inventive shoe structures disclosed here.

In I. C. Wright et al., *The Influence of Foot Positioning on Ankle Sprains,* 33 J. Biomechanics 513-519 (2000), the authors analyzed how foot positioning at touchdown influences ankle sprain occurrence. Using computer simulations with 10 subjects performing a landing phase of a side-shuffle movement, the research explored various subtalar and talocural joint angles. Wright et al. found that the angle of the subtalar joint at touchdown did not significantly affect sprain risk. However, increased plantar flexion at touchdown did lead to more sprains. This suggests that ankles with previous sprains are more prone to future injuries due to increased plantar flexion, and it highlights how and in what manner certain types of ankle taping or bracing might reduce sprain susceptibility.

Similarly, in Jay Hertel, Functional Instability Following Lateral Ankle Sprain, Sports Medicine (2000), the author discussed the neuromuscular deficits that arise after a lateral ankle sprain (LAS), leading to functional instability (FI). The article highlighted how LAS can damage not only ligaments but also nervous and musculotendinous tissues, causing issues like impaired balance, reduced joint position sense, delayed peroneal muscle response, and decreased dorsiflexion range of motion. The paper emphasizes the importance of assessing neuromuscular deficits alongside joint laxity and swelling in patients with LAS, and suggests that treatment should aim to restore both neuromuscular function and mechanical stability.

More specific to athletic endeavors such as basketball, Nardia-Rose Klem et al., *Effect of External Ankle Support on Ankle and Knee Biomechanics During the Cutting Maneuver in Basketball Players*, Am. J. Sports Medicine (November 2007) examined the effects of hinged and lace-up ankle braces on ankle and knee biomechanics in certain basketball players during cutting maneuvers. It found that while both braces limit ankle inversion, a common cause of sprains, they also increase knee internal rotation and valgus angles, potentially impacting knee injury risk. The study suggests that certain types of ankle protection devices, e.g., hinged braces, may offer better ankle support without overly restricting movement. The findings suggest a potential trade-off between ankle protection and altered knee biomechanics.

This potentially highlights the need for structural features in shoes such as athletic shoes and basketball shoes to optimize injury prevention strategies in sports.

Specific to the inversion movement that may cause or be related to ankle sprains, a 2019 study by Lu Li et al. in the Journal of Foot and Ankle Research, entitled *Function of ankle ligaments for subtalar and talocrural joint stability during an inversion movement—an in vitro study*, focused on the role of ankle ligaments in stabilizing the subtalar and talocrural joints during inversion movements. Using eight fresh-frozen specimens, the study evaluated the stabilizing function of the anterior talofibular ligament (ATFL), calcaneofibular ligament (CFL), and posterior talofibular ligament (PTFL) at different plantarflexion/dorsiflexion angles. The findings indicate that the CFL is significant for stabilizing the ankle joint against forced inversion, particularly influencing the talocrural joint during plantarflexion and the subtalar joint during dorsiflexion. This research provides valuable insights into ankle ligament functions, which could have implications for treating ankle injuries. The support or reinforcement of these ligaments, especially the CFL, is one (of many) object(s) of the present invention.

Numerous shoes are known in the art and have been developed over time. Some athletic shoes have made rudimentary attempts to incorporate features that allegedly provide varying degrees of ankle support. These include U.S. Pat. No. 4,922,630 (Nike) that discloses an athletic shoe including an alleged ankle inversion resistance device to reduce inversion, wherein a single strap is provided entirely above the ankle joint. Similarly, U.S. Pat. No. 5,771,608 (K-Swiss) discloses a shoe with an ankle strap protector that is a strap entirely above the shoe, and two separate strap assemblies on the sides of the shoe.

Other shoes have been disclosed in the prior art, including those disclosed in U.S. Pat. Nos. 6,775,929 and 9,532,625 (both to Ektio), the disclosures of which are incorporated by reference in their entirety as if set forth in full detail herein. The Ektio shoes disclose strap assemblies incorporated into shoes and disposed in proximity to a wearer's ankle. While the Ektio shoes provided some level of ankle support above what was done before, they do not provide complete support from all relevant sides, their straps and shoe components were sub-optimal both from a functional perspective (e.g., strap positioning for foot and ankle support), a comfort and wearability perspective (e.g., managing in-shoe heat, friction, chafing, padding, etc.), design convenience (with the intention of easing putting on and taking off the shoe, padding, etc.), design, ease and cost of manufacturing, and further lacked supportive features and components functioning in cooperation with the straps to position and secure the straps for supporting the ankle ligaments. The Ektio shoes are not believed to have provided the "360-degree lock-down" effects as described herein. Additionally, the Ektio straps did not engage with the other components of the shoe in a manner sufficient to provide fulsome support to the relevant ligaments in the ankle described above.

There exists a need for a shoe that will reduce or prevent ankle injury and inversion or eversion sprains, especially for those users who have already experienced ankle injuries, while still allowing for a full and substantially full range of ambulatory and/or athletic motion. There exists the further need for a shoe closure system that effectively protects the ankle of a user and is facile and easy enough for an average user to engage and disengage in a reasonable amount of time given the structural complexity of the shoe. There also exists the need for a shoe that provides complete coverage and support for a user's ankle from all relevant sides. And in such cases, there exists the need for a shoe fastening mechanism or structures such as straps, wherein the mechanisms or attachment means and other features of the shoe provide adequate support for the structure of the ankle that are most implicated in ankle sprains, including the CFL, ATFL and PTFL ligaments.

The present invention satisfies these and other real and present needs. Those skilled in the art will appreciate certain conventional shoe components may be utilized to implement one or more of the features of the subject invention without deviating from the inventive aspects of the present disclosure.

BRIEF SUMMARY OF THE INVENTION

Certain terminology is used in the following description for convenience only and is not limiting. Unless specifically set forth herein, the terms "a," "an," and "the" are not limited to one element but instead should be read as meaning "at least one." The words "right," "left," "lower," and "upper" designate directions in the drawings to which references are made. Similarly, the words "inwardly" or "distally" and "outwardly" or "proximally" refer to directions toward and away from, respectively. The words, "anterior," "posterior," "superior," "inferior," "lateral," and related words and/or phrases designate preferred positions, directions and/or orientations to which references are made and are not meant to be limiting. The terminology includes the above-listed words, derivatives thereof and words of similar import.

It should also be understood that the terms "about," "approximately," "generally," "substantially" and like terms, used herein when referring to a dimension or characteristic of a component of the preferred invention, indicate that the described dimension/characteristic is not a strict boundary or parameter, and does not exclude minor variations therefrom that are functionally the same or similar, as would be understood by one having ordinary skill in the art. At a minimum, such references that include a numerical parameter would include variations that, using mathematical and industrial principles accepted in the art (e.g., rounding, measurement, or other systematic errors, manufacturing tolerances, etc.), would not vary the least significant digit.

Briefly stated, the present invention is directed to a shoe for preventing or reducing ankle injuries. In some embodiments, the shoe may be provided with one or more straps that secure the foot and especially the ankle within the shoe. Embodiments may further include one or more of the following features: midfoot webbing to support the foot; a heel cup to support the ball of the heel and position the ankle within the shoe relative to the ankle-securing features; heel counters that may be internal or external or both to support and position the heel relative to the ankle-securing features; a shoe lining that may take the form of inner heel channel for cushioning and optimal positioning of the straps; and other features that secure and support the foot and ankle within the shoe. In some embodiments, the shoe may provide a form of "360-degree lockdown," which is a supportive effect that secures the foot and ankle at an optimal position within the shoe while also specifically providing support and lockdown of the ligament and muscle structures known to be at risk of displacement in sport-related ankle and foot injuries. Such 360-degree lockdown may be provided through a combination of one or more of straps, wire closure devices, a deep heel cup in the insole, midfoot webbing, heel counters (internal and/or external, with a substantial overlap between internal and external heel counters) and in-shoe booties or liners, such that the wearer's foot is sufficiently well secured and the wearer's relevant ligaments (CFL, ATFL, PTFL) and Achilles tendon are supported, while still providing enough range of motion to engage in athletic endeavors. In some alternate embodiments, the straps alone may provide 360-degree lockdown due to specific positioning wherein the first strap and/or second strap effectively encircles the wearer's foot when viewed from a top-down direction. These 360-degree lockdown effects will be further described through the operative embodiments disclosed herein.

Other features and advantages of the invention will be apparent from the following specification viewed in conjunction with the following drawings.

BRIEF DESCRIPTION OF THE SEVERAL VIEWS OF THE DRAWINGS

The foregoing summary, as well as the following detailed description of certain preferred embodiments of the shoe of the present invention, will be better understood when read in conjunction with the appended drawings. It should be understood, however, that the description is not limited to the precise arrangements and instrumentalities shown. In the drawings.

Figure 1:
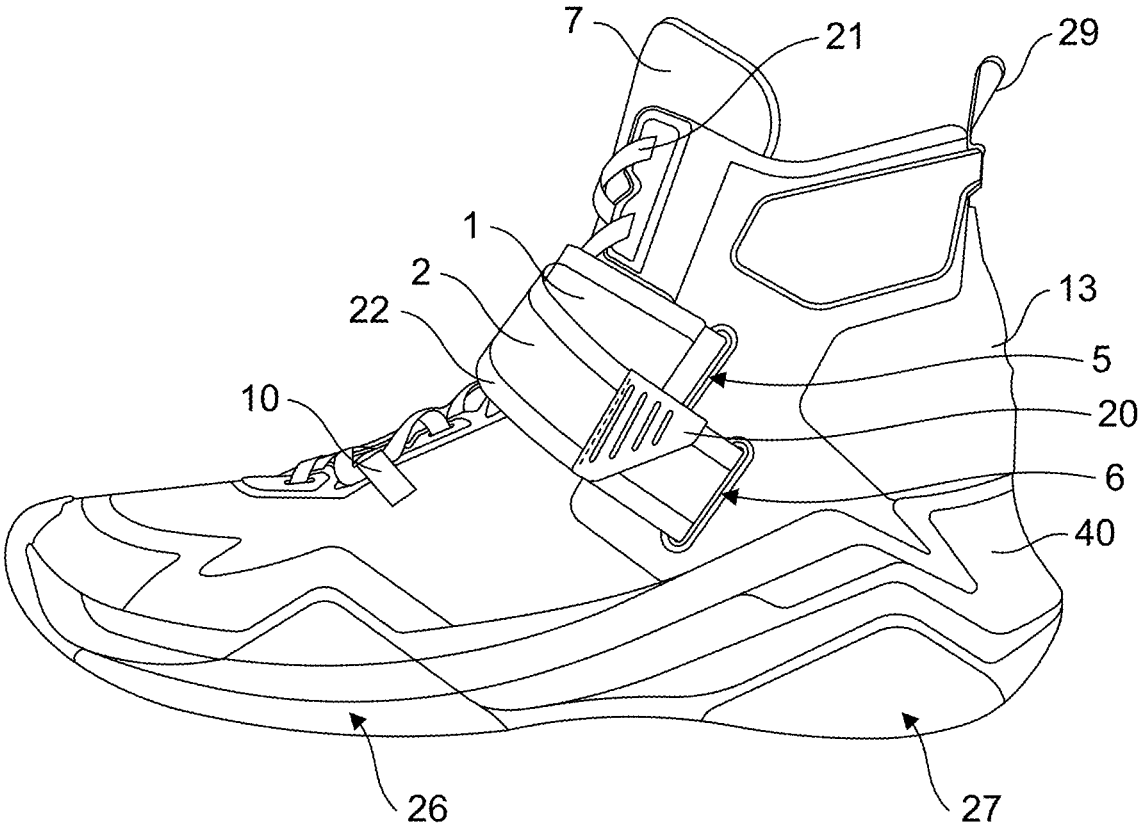
FIG. 1 is a lateral view of an embodiment consistent with the present disclosure, showing a lateral side of a shoe (i.e., the view from the left side or outer side of a shoe that goes on a wearer's left foot)

These and other embodiments will be further explained through the description below.

DETAILED DESCRIPTION OF THE INVENTION

While this invention is susceptible of embodiment in many different forms, there is shown in the drawings, and will herein be described in detail, several non-exclusive preferred embodiments of the invention with the understanding that the present disclosure is to be considered as an exemplification of the principles of the invention and is not intended to limit the broad aspect of the invention to the embodiments illustrated.

Straps: One embodiment of the shoe features one or more straps that secure the ankle within and to the shoe to prevent or reduce the risk of ankle injuries. In some aspects, the straps may provide some indicia or protective aspects of a protective boot worn by patients after ankle injuries or treatments to prevent re-injury. However, the shoe and straps have significant further design and functional advancements that allow for their use in ambulatory movements and athletic competition by enhancing mobility while still ensuring adequate protection to the ankle. These and other benefits are described below and would be appreciated by those of skill in the art upon reading the disclosure herein.

Figure 2:
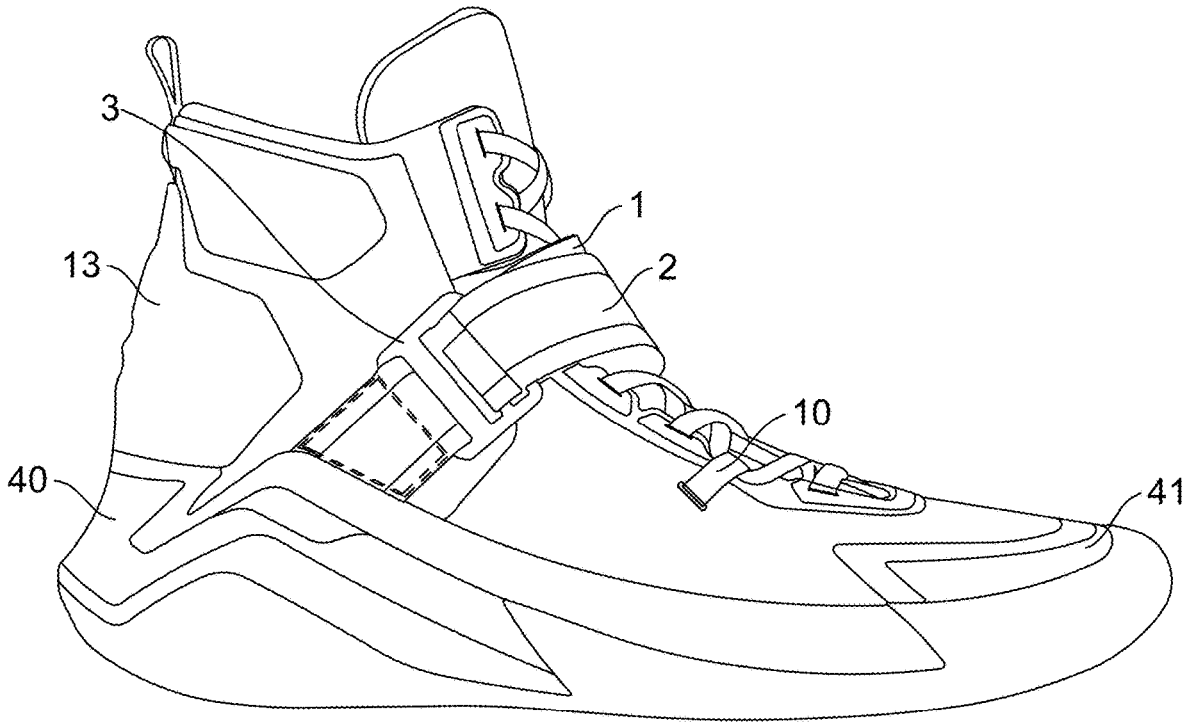
FIG. 2 is view of an embodiment consistent with the present disclosure, showing a medial side of the shoe of FIG. 1 (i.e., the view from the right side or inner side of a shoe that goes on a wearer's left foot)

Turning now to FIGS. 1 and 2, there is shown an exemplary embodiment of a shoe consistent with some aspects of the present invention. FIG. 1 shows a lateral view of the shoe (i.e., in FIG. 1, looking at the left side perspective of a left foot shoe, from the outside of the foot looking inward) and FIG. 2 shows a medial view (i.e., in FIG. 2, looking at the inside or right side of a left foot shoe, from the inside of the foot looking outward). The shoe in FIGS. 1-2 is provided with two straps, a first strap 1, and a second strap 2, that help to secure the wearer's foot within the shoe.

In some embodiments, a first strap is made preferably of a strong and flexible material that has good tensile strength and does not easily wear out. The first strap will preferably measure approximately 0.5-3 inches in width (preferably 1-2 inches) with a length that varies depending on the size of shoe.

The first strap may be attached to the inside of the shoe by any means known in the art. In some embodiments, the first strap is attached to the inside of the shoe by sewing or riveting or both.

One purpose of the first strap (preferably in conjunction with the second strap) is to intimately fix the foot to the shoe to reduce or eliminate the displacement or slippage that may occur during ambulatory and/or athletic movements, including running, cutting, jumping and stopping. More specifically, the first strap serves to lock the wearer's heel to the heel cup and heel counters, while the second strap locks the foot to the footbed—these features and functionalities are described more fully in the following paragraphs of this disclosure. The straps also serve to reduce or eliminate displacement that may occur during forced inversion of the ankle. This in turn will prevent or reduce the lateral and vertical motion (reducing or eliminating foot lag) that may lead to tears in the ligaments relevant to ankle injuries. In some embodiments, the first strap may be positioned so as to cross the shoe approximately perpendicular to the ATFL in order to support the ligament.

The bottom of the shoe upper is provided with a Strobel, which is a fabric or non-woven material used to finish the bottom of a shoe upper. The Strobel is designed and positioned so as to add support to the shoe body when worn. In some embodiments, the Strobel may be made from engineered thermoplastic polyurethane (ETPU) for optimal stiffness, support and stability. At a high level, the hardness is optimized so as to provide a softer tactile feel in portions exposed to the wearer's foot, with harder sole portions of the shoe separated from the foot. In some preferred embodiments, a Strobel machine may be used to make a Strobel stitch to attach the Strobel to the upper. The structure and function of such a Strobel stitch would be readily understood by one of skill in the art, and in the case of the present invention the Strobel stitch serves to provide additional support to the shoe structure and support the foot of a wearer.

In some alternate embodiments, the shoe may be provided with a first strap that is attached to the shoe at the Strobel.

Figure 3:
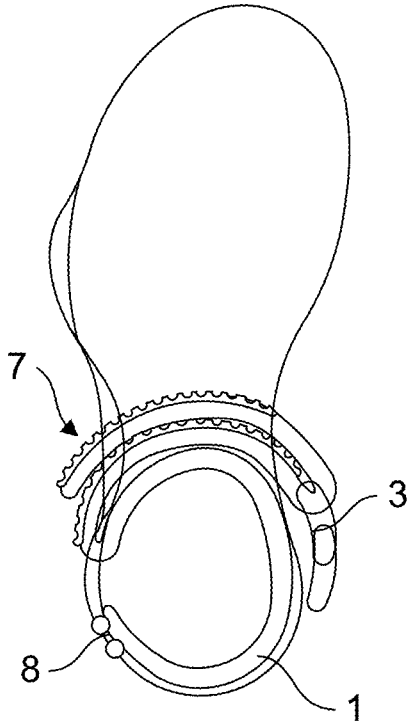
FIG. 3 is an aerial or plan view from a top-down perspective, showing an embodiment of the first strap of the present invention with an outline of the strap as it may be positioned on a shoe.
Figure 8:
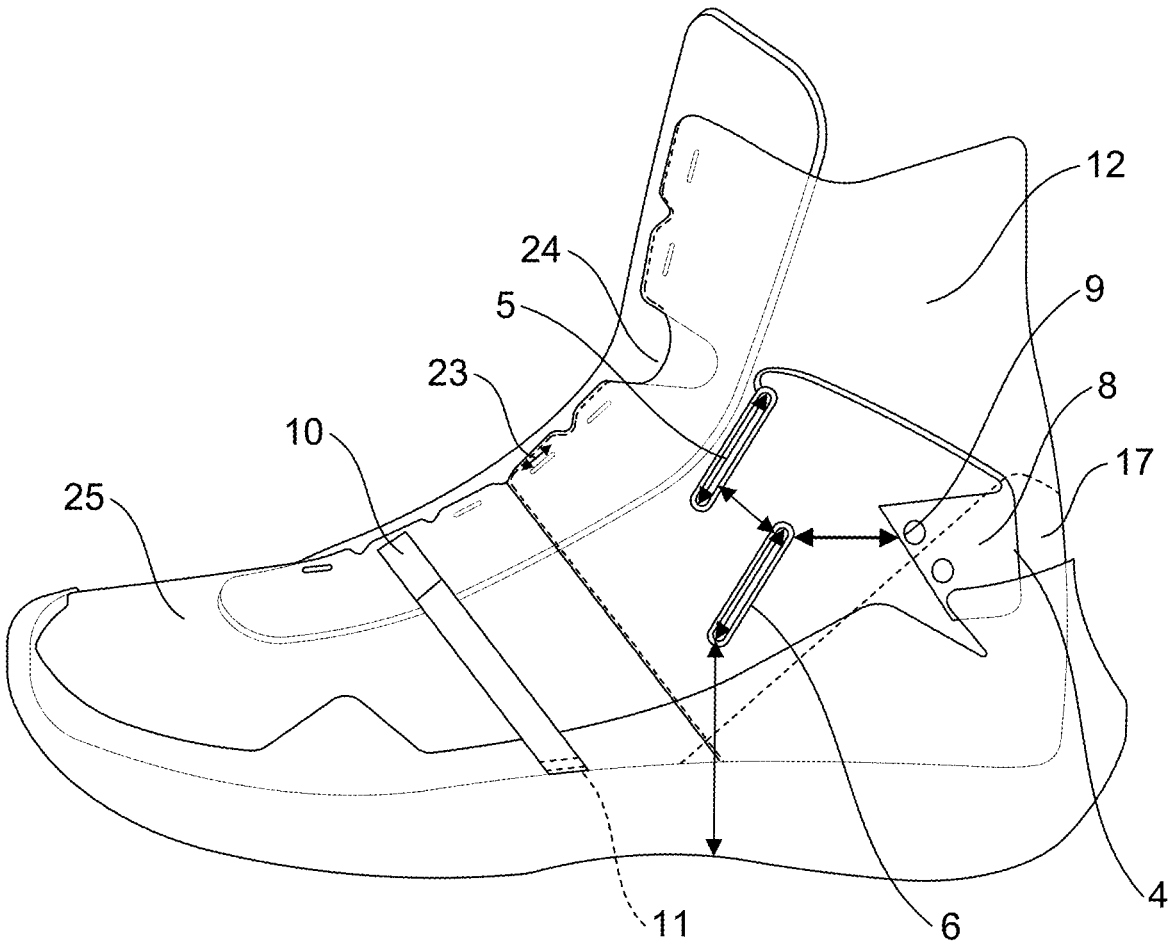
FIG. 8 is a lateral sectional view of an embodiment consistent with the present disclosure, showing certain internal and external features and components of a shoe.

In terms of positioning, a first strap is attached to the lateral side of the shoe, by affixing the strap to the sole, the sidewall, and/or the Strobel. In some preferred embodiments, the first strap is attached to the lateral sidewall (i.e., to a component of the upper) of the shoe. The attachment of the first strap to the shoe is preferably within the body of the shoe and/or within the sidewall of the shoe, i.e., where the first strap is not directly in contact with the wearer's foot at or proximate to the first strap's attachment to the shoe. An exemplary attachment point of the first strap to the shoe is shown in FIGS. 3 and 8. As shown in FIGS. 3 and 8, the first strap attachment may be at the lateral sidewall above the Strobel, at a position that is near the lateral malleolus of the foot (in preferred embodiments, as in FIGS. 3 and 8, partially below and behind the lateral malleolus), in a direction such that the first strap may angle gentle upwards in its extent as it begins to wrap around the back of the ankle.

Turning specifically to FIG. 8, there is shown an exemplary attachment point 8 of the first strap 1 to the body of the shoe within the lateral sidewall, through the use of a pair of rivets marked 9. The attachment may be made by means of stitching, e.g., a box stitch, instead of or in conjunction with rivets.

Figure 4:
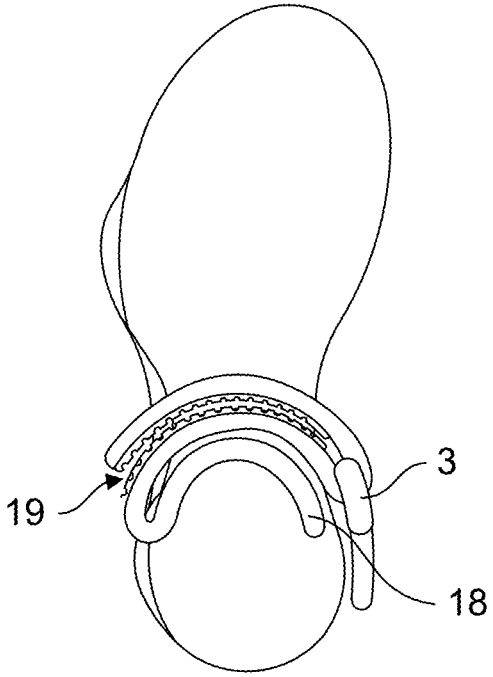
FIG. 4 is an aerial or plan view from a top-down perspective, showing an embodiment of the second strap of the present invention with an outline of the strap as it may be positioned on a shoe.
Figure 5:
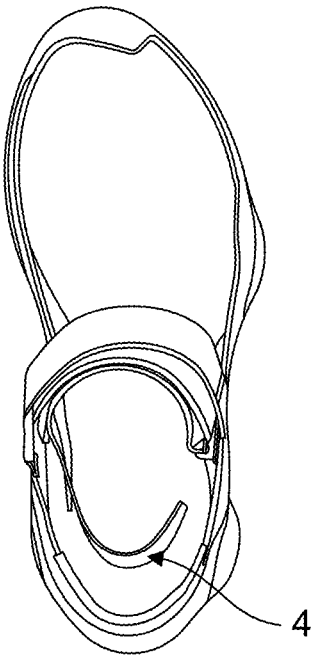
FIG. 5 is an aerial or plan view from a top-down perspective, showing an embodiment of a first strap and a second strap of the present invention with an outline of the straps as they may be positioned on a shoe.

The first strap may then be positioned to wrap partially or completely around the back of the wearer's ankle, as shown in FIGS. 4-5 and 8, wherein the portion of the first strap that wraps around the back of the ankle is labeled 4. The first strap is positioned with the intent to approximately cover the CFL ligament and also extend across the ATFL, supporting both of these structures. This also provides support to the PTFL ligament. An important aspect of the positioning of the first strap, consistent with the present invention, is the support provided to the CFL ligament and the directional positioning substantially parallel to the CFL ligament.

Figure 6:
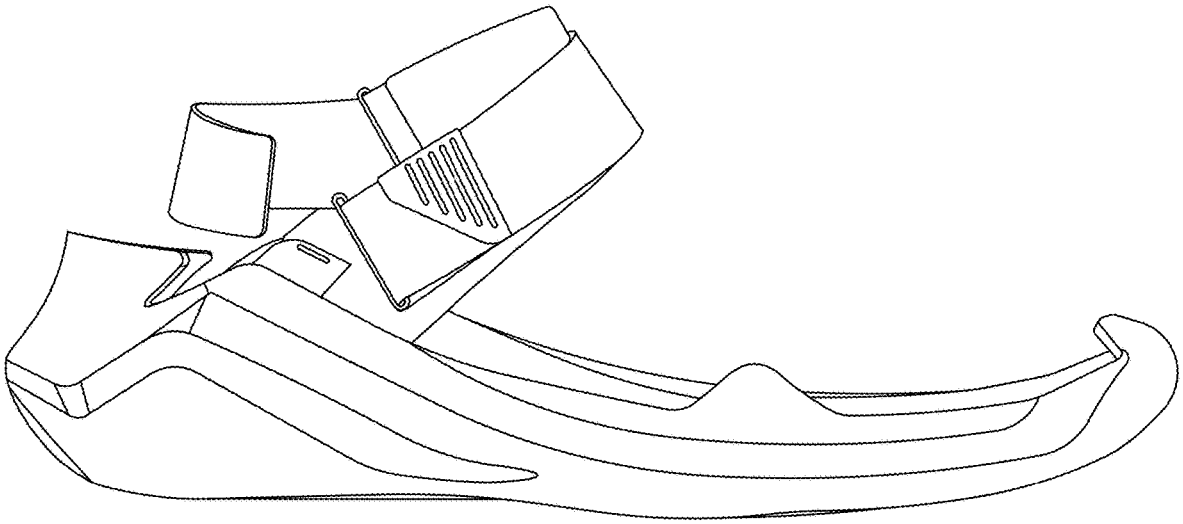
FIG. 6 is a lateral side view of the embodiment of FIG. 5 showing a first strap and a second strap of the present invention with an outline of the straps as they may be positioned on a shoe.

As can be seen in FIG. 6, the first strap may be positioned at a positive angle to the horizontal, so as to gently ascend as it wraps around the back of the wearer's foot, within the walls of the shoe. The angle of ascent of the first strap, starting at its attachment point and through the inside of the sidewall, may be between 5-degrees and 60-degrees, more preferably between 10-degrees and 45-degrees, and in some embodiments approximately 30-degrees above the horizontal. An example of such ascending direction of the wrap-around portion of the first strap can also be seen in FIG. 8, with the portion marked 4. As such, in some embodiments, the first strap may be positioned so as not to interfere with or put undue pressure on the insertional point of the Achilles tendon while still providing support to the back of the foot. The first strap wraps upwards in a generally semi-vertical direction to provide support to the tendon and proximal ligaments.

The first strap may then be positioned so as to first emerge out of the inside of the medial wall of the shoe, after wrapping (fully or partially) around the wearer's ankle within the wall of the shoe, optionally through a channel or track that allows the first strap to be pulled or moved within the wall. The first strap may angle up when disposed within the wall of the shoe and wrapping around the ankle, and the first strap may extend in a posterior and superior direction within the optional channel within the shoe wall. The first strap's emergence from the medial wall may be through a slit, optionally a reinforced slit. The first strap may then extend horizontally over the top of the wearer's foot, approximately perpendicular to the lateral and medial sidewalls of the shoe. The first strap will generally be higher on the top of the foot than the second strap, and combine to cover a larger area of the top of the foot.

In most instances, the shoe will be provided with a tongue, e.g., tongue 7 shown in FIGS. 1-2. The horizontal extension of the first strap after emerging from the medial wall may, in some embodiments, be between the tongue of the shoe and the laces, such that the first strap is physically separated from the wearer's foot by the tongue of the shoe to prevent friction and chafing, increase comfort, and provide a supportive lockdown for the front and upper area of the ankle. In some embodiments, the tongue may be provided with an optional loop on its upper surface, with the first strap passing through said loop to optimize its positioning relative to the ankle ligaments.

After extending horizontally between the medial and lateral shoe walls as described, the first strap may then be positioned so as to pass through and emerge out of the lateral sidewall of the shoe through a slit (e.g., a lateral slit) which is disposed in the shoe above the sole and preferably above the Strobel. In some embodiments, this slit comprises a reinforced opening, such as a molded plastic piece that defines the opening of the slit. An exemplary embodiment of such slit for emergence of the first strap is shown as slit 5 in FIG. 1.

The first strap may then be positioned so as to be capable of folding back over the top of the shoe (wherein the first strap folds back partially or substantially over itself) so as to wrap over the upper surface of the shoe towards a buckle positioned on the medial side of the shoe. In some embodiments, this first folding back of the first strap is done and positioned above the laces of the shoe. This is shown, for example, as the portion of the first strap 1 that is visible in FIG. 1, emerging through the slit 5 in the lateral wall of the shoe and wrapping around/over the top of the shoe, above the laces 21. The laces are provided typically on the top surface of the shoe, where the laces engage with the shoe by being threaded through eyelet holes, an example of which is shown as 23 in FIG. 8. When wrapping over the top of the shoe, the first strap 1 may be located approximately perpendicular to both the medial and lateral sidewalls of the shoe.

Figure 9:
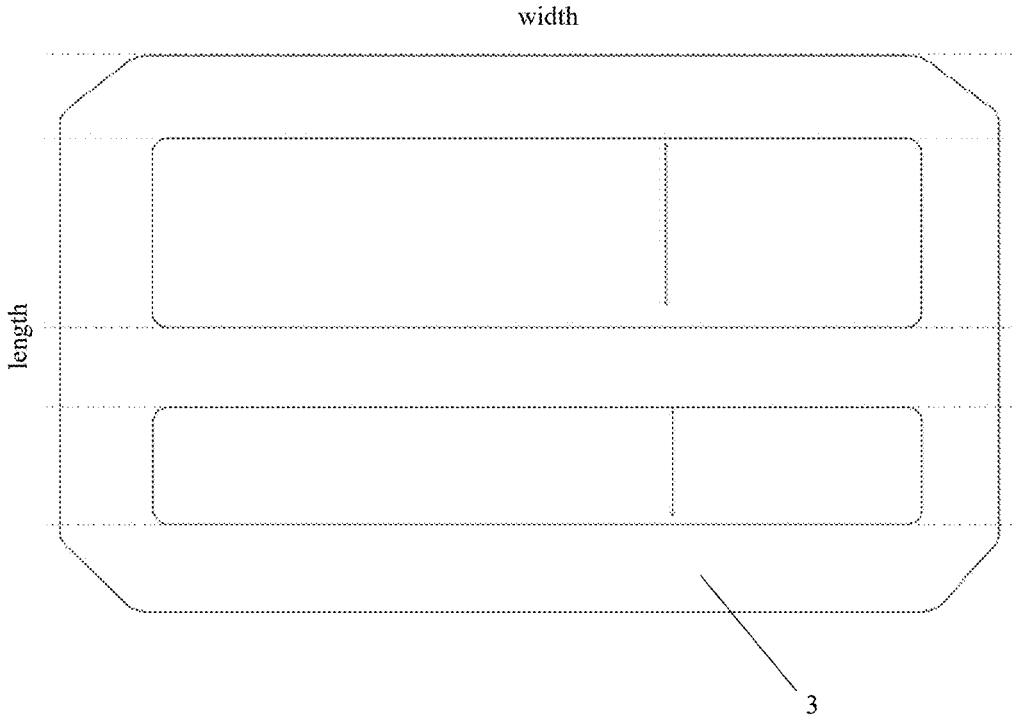
FIG. 9 shows a frontal view of a shoe buckle consistent with portions of the present disclosure.

After passing over the top of the shoe, the first strap may then engage with a buckle, e.g., as shown in FIG. 2, wherein the first strap is shown engaged with buckle 3. In some embodiments, the buckle 3 may be a made of a strong material like metal, TPU, or molded plastic. An exemplary buckle consistent with the present disclosure is shown in FIG. 9, wherein a buckle 3 is shown having openings through which straps may be passed. The openings can be of uniform width, but are preferably of different widths, optimized for the types and thicknesses of the first and second straps. In some embodiments, the buckle may be substantially rectangular in shape. In a preferred embodiment as shown in FIG. 9, the buckle is a rectangle that is wider than it is long, with two openings in the buckle wherein the top opening has the greatest width (e.g., between 5 mm and 10 mm, preferably between 7 mm and 9 mm, and most preferably 8 mm), and the bottom opening has the smallest width (e.g., between 3 mm and 7 mm, preferably between 4 mm and 6 mm, and most preferably 5 mm). The transverse sections of the buckle (i.e., the horizontal portions in FIG. 9) may be of substantially uniform thickness, preferably about 5 mm thick.

Subsequent to engagement of the first strap with the buckle 3, the first strap may be then be once again folded backward on itself, this time directed back toward the lateral side of the shoe. This can be seen, for example, in the visible portion of the first strap 1 seen in FIG. 2, where the first strap is engaged with the buckle 3 and is then wrapped back over itself extending directionally towards the lateral side of the shoe. The first strap is then preferably secured in position, terminating in a direction generally disposed towards the lateral side of the shoe.

Upon so terminating, the first strap may be secured to itself by any fastening or engagement means known in the art, including (as non-limiting examples) Velcro, buttons, cooperation portions of one or more zippers, hooks, pins, clips, cinching means, laces or ties, snap fasteners, slide fasteners, cooperating securing means on a first portions and a second portion of the first strap, etc. In a preferred embodiment, the engagement means is Velcro with cooperating Velcro portions on the underside of the terminating portion of the first strap and on the upper portion/surface of the portion of the first strap that previously emerged from the lateral outside sidewall of the shoe and bent back towards the medial side. This can be seen, for example, in FIG. 3, which shows Velco fastener portions 7.

Second Strap: In some embodiments, the shoe is provided with a second strap. The second strap may be made of a strong, durable material similar to that of the first strap, with a width similar to that of the first strap. In some embodiments, the second strap originates and is firmly attached to the inside of the shoe, such as by sewing or riveting or both within the medial sidewall. The second strap is attached approximately at the junction of the sole and medial sidewall of the shoe, (e.g., at the Strobel) or may be attached slightly above such level in the medial sidewall upper. An exemplary second strap 2 is shown in FIGS. 1-7. In a preferred embodiment, the second strap is attached to the shoe by means of a box stitch. Such attachment point is exemplified as 18 in FIGS. 4 and 7.

Figure 7:
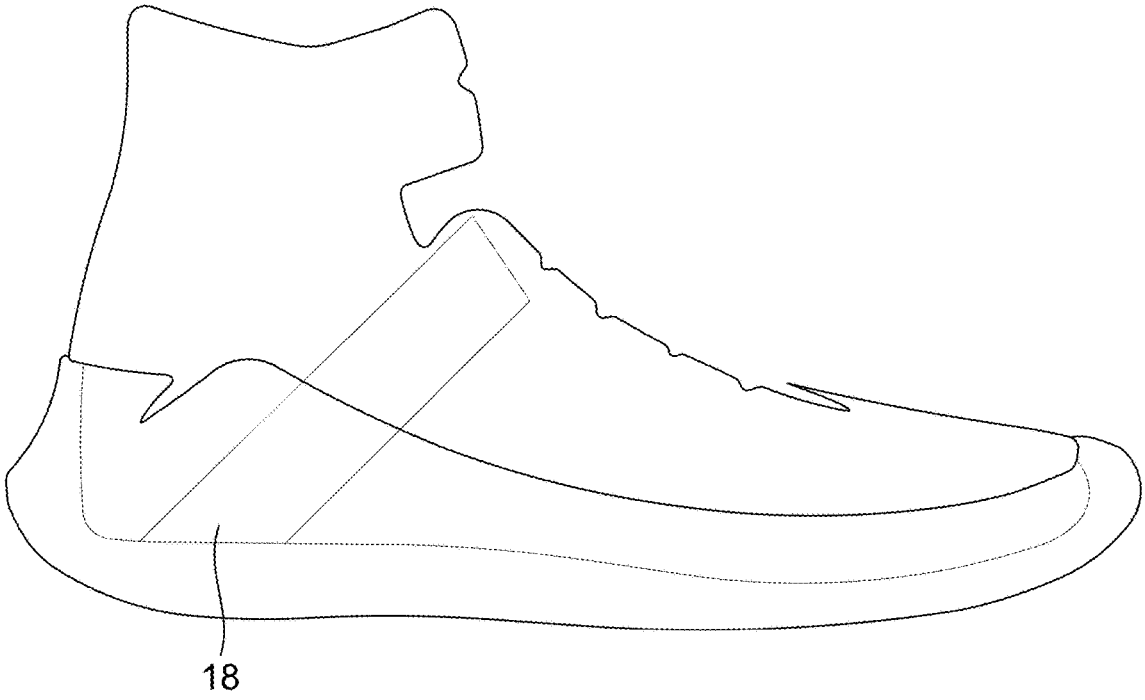
FIG. 7 is a lateral side view of an embodiment consistent with the present disclosure, showing an outline of a portion of the second strap and its attachment to the shoe.

The second strap extends through the inside of the medial sidewall, in a direction angled upwards, as shown for example in FIG. 7. The angle of ascent of the second strap through the inside of the medial sidewall is between 30-degrees and 90-degrees, more preferably between 50-degrees and 70-degrees. The positioning of this portion of the second strap is advantageous in that it provides support to the anterior tibiotalar ligament and deltoid ligament, to prevent displacement or separation of both. The angle of ascent of the second strap may be positioned so as to roughly cover and/or run substantially parallel to the tibiocalcaneal ligament. The second strap in cooperation with the first strap provides support to the CFL and ATFL to prevent displacement and slippage of the foot during ambulatory and/or athletic movements.

The second strap emerges out of the inside of the medial sidewall of the shoe, and in some embodiments extends within the shoe, positioned above the wearer's foot near the ankle. In some preferred embodiments, the first and second straps both emerge out of the inside medial sidewall of the shoe through the same elongated slit or opening.

After emerging from the inside of the medial sidewall of the shoe, the second strap is positioned so as to extend over the top of the wearer's foot/ankle, in a direction extending from the medial side to the lateral side of the shoe. In some embodiments, this extension of the second strap is positioned between the tongue of the shoe and the laces of the shoe, so as to avoid coming into contact with the wearer's foot within the shoe. In some embodiments, this portion of the second strap that emerges from the inside medial sidewall and extends towards the lateral sidewall is positioned so as to be substantially beneath the first strap, sandwiched between the tongue and laces of the shoe.

The second strap may then pass through the lateral sidewall of the shoe, through an opening or slit in the lateral sidewall, in a direction from the inside of the shoe to the outside, and then emerge out of the outside of the lateral sidewall. In some embodiments, the second strap emerges out of a slit in the lateral sidewall of the shoe that is positioned below the slit that the first strap emerged out of. This is shown, for example, in FIGS. 1 and 8, wherein the second strap 2 emerges of slit 6 that is below slit 5 from which first strap 1 emerged. In an alternate embodiment, the second strap may emerge out of the same slit as the first strap. In another alternate embodiment the second strap may extend through the tongue of the shoe, wherein the tongue is designed to accommodate and surround the first and second straps.

After emerging through the lateral sidewall, the second strap may be positioned so as to extend over the top of the shoe, above the laces, in a direction extending from the lateral to the medial side of the shoe. In some embodiments where the tongue is provided with one or more loops on its upper surface, the second strap may engage with the loop (i.e., be passed through the loop) to help secure it in an optimal position with respect to the ligament structures of the ankle.

After extending from the lateral to the medial side of the shoe, the second strap may then engage with the buckle located on the medial outside side of the shoe, and then be positioned so as to fold back on itself, similar to the first strap. This can be seen, for example, in FIG. 2, which shows the second strap 2 engaged with the buckle 3 and then folding back on itself. A different perspective of the same embodiment is shown in FIG. 1, where the terminal portion 22 of second strap 2 is shown folded back on top of the strap, and terminates in an optional tab 20.

The terminal portion of the second strap is preferably secured in position, in a direction generally disposed towards the lateral side of the shoe. Upon so terminating, the second strap may be secured to itself by any fastening or engagement means known in the art, including (as non-limiting examples) Velcro, buttons, cooperation portions of one or more zippers, hooks, pins, clips, cinching means, laces or ties, snap fasteners, slide fasteners, cooperating securing means on a first portions and a second portion of the first strap, etc. In a preferred embodiment, the engagement means is Velcro, with cooperating Velcro portions on the underside of the terminating portion of the first strap and on the upper portion/surface of the portion of the first strap that previously emerged from the lateral outside sidewall of the shoe and bent back towards the medial side. This can be seen, for example, in FIG. 4, which shows Velco fastener portions 19. In a preferred embodiment, the terminal portion of the second strap engages with both the second strap and first strap (e.g., through Velcro). This is shown, for example, in FIGS. 3 and 4, wherein FIG. 3 shows a portion of Velcro on the outside surface of the terminal portion of the first strap, and FIG. 4 shows a portion of Velcro on the underside of the terminal portion of the second strap. Thus, when the second strap is secured, the Velcro portion on the underside of the terminal portion of the second strap may be engaged with both the Velcro on the second strap and the Velcro on the outside surface of the terminal portion of the first strap, to secure both straps in place and position them optimally on the top of the foot. This can also be seen by the partial overlap between the first and second straps shown in FIG. 5, and also in FIG. 1 wherein the terminal portion of second strap 2 is positioned partially over strap 1. As such, the Velcro on the outside of the terminal portion of the first strap may be angled to be a wedge or substantially triangular shape, tapering in direction from the medial to the lateral side of the shoe, based on how much of the second strap is intended to be engaged with the outer surface of the terminal portion of the first strap.

In one preferred embodiment, the first strap and second strap are in contact with one another, both in the portions of the straps that are sandwiched between the tongue and laces, and the portions of the straps that are above the laces. In a preferred embodiment, the straps do not have the shoe tongue separating the portions of the straps. This serves an important function of preventing relative displacement of the straps with respect to each other, as they are held together substantially in place by friction, as compared to if the straps were separated by the tongue. Keeping the straps together in this way also supports the ankle ligaments (through directional positioning of the first and second straps) while also enabling the inclusion of a padded tongue and preventing chafing or discomfort caused by the straps coming into contact with the wearer's skin or being separated from the wearer's skin by only a thin layer of the shoe. Such a padded tongue would also impart strength and durability to the overall shoe structure as compared to a thinner mesh tongue. Another advantage of this configuration is allowing the shoe to have less (or none) of an internal lining or bootie, because the cushioning provided by a padded tongue vitiates the need for a bootie lining extending up where the tongue is positioned. Having a padded tongue rather than a bootie saves times when the wearer puts on and takes off the shoe. This also increases comfort and makes the inside of the shoe less prone to heating or overheating when wearing, while still providing sufficient support and cushioning. Another advantage to this configuration is that the shoe is lighter on account of using less material, and also typically cheaper to manufacture because the tongue and adjacent portions do not require two separate pieces that are stitched together as would be required for a bootie-and-tongue configuration.

In another alternate embodiment, the first strap may be attached to the shoe approximately below the position of the slit through which the first strap passes through the lateral wall of the shoe. Thus, for example, in FIG. 3, the attachment point 7 of the first strap 1 to the shoe may be roughly in line with the first fold-back of the first strap 1 on the lateral side of the shoe, such that the first strap would form a circle around the ankle when view from the top-down direction of FIG. 3. Similarly, in FIG. 8, for this alternate embodiment, the attachment point 8 would be moved to be approximately below the slits 5 and/or 6 of the shoe. This alternate embodiment would provide one type of "360-degree lockdown," because of the general substantial encirclement of the ankle by the first strap as described. In another aspect of this alternate embodiment, the starting point/portion of the first strap may be at the Strobel on the lateral side of the shoe, at a position that is linear to the midpoints of the two slits in the lateral wall from which the straps emerge laterally. So, for example, in FIG. 8, the attachment point 8 would be moved (as compared to that shown in FIG. 8) to be located on the Strobel at a position that is roughly along the straight line connecting the widthwise midpoints of the two slits 5 and 6 and extended down to the Strobel.

Integral Padded Heel Channel: The shoe also includes a heel channel that may be an integral padded channel for the straps, wherein in preferred embodiments said heel channel forms an inner heel liner that accommodates a wearer's foot inside the shoe. The heel channel is located inside the shoe and provides structural support for holding the straps up and adjacent to the inside walls of the shoe. The heel channel facilitates putting the shoe on and provides comfort to the wearer by creating a buffer between the wearer's foot and the portions of the straps inside the shoe, thereby preventing the straps from making contact with, and irritating, the skin of the wearer's foot and ankle. The heel channel also functions to stabilize the wearer's foot within the shoe by restricting the foot's freedom to move laterally between the walls of the shoe.

An exemplary embodiment of such a heel channel is shown in FIG. 8, wherein the heel channel 12 is positioned within the shoe. In a preferred embodiment, the heel channel extends up the medial and lateral walls of the rear portion of the shoe (proximal to the ankle) and up the internal wall of the back seam of the shoe, but the heel channel does not extend over the wearer's foot between the medial and lateral walls, i.e., the heel channel does not overlap with the tongue of the shoe over the top of the wearer's foot. The heel channel is attached to the sole of the shoe at the junction of the upper and the sole, or at the Strobel, through techniques commonly known in the art, such as stitching, gluing or molding. The heel channel serves to cushion and prevent abrasions from the shoe's internal straps and fasteners. An alternate embodiment may include a padded heel channel that comprises a double-layered liner.

In the above embodiments, the heel channel is provided with openings or apertures (e.g., slits or holes) that allow the straps to pass through it, e.g., openings corresponding to slits 5 and 6 on the lateral wall of the shoe of FIG. 8, and/or an opening in the inner boot lining or half bootie corresponding to the opening in the inner medial wall of the shoe from which the straps emerge.

In preferred embodiments, the heel channel does not extend forward within the shoe to the toes (i.e., does not extend past the midfoot region of the shoe). This provides the benefits of allowing toe splay and reducing or preventing excessive foot compression in the forefoot, and improving internal temperature of the shoe when worn and reducing sweat and smell when wearing the shoe. In such embodiments, the shoe may further be provided with a midfoot webbing to secure the midfoot, as described further below. In preferred embodiments, the internal bootie does not overlap with the midfoot webbing.

Midfoot Webbing: In some embodiments, the shoe is provided with webbing in the midfoot area of the shoe. One functional purpose of this webbing is to provide stabilization throughout the front of shoe and help secure the middle of the foot. In some aspects, this webbing may be sole-to-lace webbing or, in some aspects, affixed to and extending from the Strobel, upward to the laces. Such webbing also provides aesthetic benefits. This midfoot webbing is exemplified in FIG. 8, which shows a webbing 10 that extends from an attachment point 11 that is attached (for purposes of the FIG. 8 exemplary embodiment) to the Strobel of the shoe by any appropriate attachment means, e.g., stitching or riveting, and preferably a box stitch. In some embodiments, the midfoot webbing is positioned between two or more layers of the shoe upper. In such embodiments, the midfoot webbing is attached to the sidewall or Strobel or sole (preferably the Strobel) of the shoe, within the walls of the shoe (i.e., not visible to the user) and then ascends upward at an angle and emerges out of the shoe wall through a slit (may be reinforced or plastic), wherein the upper terminal end of the midfoot webbing engages with the laces through any engagement means known in the art (in some embodiments, a loop or eyelet through which the laces are threaded). In one preferred embodiment, the midfoot webbing is sandwiched between layers of the upper and the sidewalls of the shoe, e.g., (from the outer layer of the shoe going in)—mesh layer of the upper, webbing, padding, and soft cushioning, wherein the soft cushioning layer is meant to contact the foot (or optional socks) of the wearer, enhance comfort, and prevent chafing. Such a midfoot webbing has the functional benefits previously discussed. As shown in FIG. 8, the webbing has an angle of ascent relative to the horizontal that is between 45-degrees and 90-degrees, preferably between 50-degrees and 75-degrees, and more preferably around 60-degrees. The precise angle may depend on the size of the shoe, while accomplishing the lockdown effects described herein.

In some embodiments, the webbing forms a component of the 360-degree lockdown effect described herein. In such embodiments, the webbing serves to hold the foot securely within the shoe to provide sufficient lockdown while still providing sufficient "give" or movement ability for the user to perform ambulatory and/or athletic movements. The webbing also secures the foot and ankle in an optimal position such that the deep heel cup, straps, and internal and/or external heel counters can provide the appropriate support for the heel and ankle ligaments as previously described. A substantial benefit of a shoe in accordance with the present disclosure is to optimize the foot placement and movement-accomplished by achieving optimal heel placement and substantial lockdown in the heel portion of the foot to maximize control of the foot coming from/directed by the heel; moderate supportive lockdown in the midfoot region to enhance stability and control while allowing for ambulatory and athletic movements and change of direction; and a natural or substantially free toe splay in the forefoot to enhance finer movements, grip, and tactile feel/feedback by allowing the toes to naturally direct the foot and body movement. All of this is optimized through the form of 360-degree lockdown described herein.

In some embodiments, the shoe is provided with laces that are generally on the top surface of the shoe disposed axially. As discussed, the shoe may be provided with a midfoot webbing that extends down from the laces to the Strobel, as exemplified by webbing 10 in FIG. 8. In some embodiments, the shoe's laces are positioned such that they pass through the webbing. This configuration provides additional stability to the shoe and to the webbing. In some aspects, the webbing attaches to the laces. This provides further stability as part of or in addition to the lockdown effect of the shoe straps. For example, as in FIG. 8, the midfoot webbing is provided with an eyelet or loop at the top that engages with the laces (shown by the line delineating the top portion of the webbing 10 in FIG. 8) to provide for further foot stabilization and overall structural and functional stability of the shoe, while still allowing for sufficient flexibility to engage in ambulatory and/or athletic movements.

The webbing is secured to the Strobel by sewing or riveting or both, e.g., by a box stitch. In some embodiments the webbing may be positioned between an outer mesh and inner lining of the shoe upper, where the inner lining may be constructed of a synthetic or semi-synthetic material of sufficient strength, e.g., NYLEX or similar material. In some embodiments, foam is inserted or affixed to the webbing at or near where it contacts the Strobel or sole, to provide additional stability and help ensure that the webbing does not excessively move around when the shoe is in use. In preferred embodiments, the foam is a full layer between the mesh and Nylex, and the foam is made of an appropriate material (e.g., tricot) that prevents chafing but also protects and adds strength to the Nylex layer. From outside of the shoe to in at the midfoot webbing, the layers of a preferred embodiment would be: outside mesh, webbing, foam, Nylex inside, and then in contact with the wearer's foot/socks.

Upper: The shoe is provided with an upper component. Such upper component preferably has sufficiently stiff consistency to prevent substantial deformation of the shoe upper and/or the types of acute angles that form during inversion stresses. The upper may comprise one or more layers, each of which provide functional and aesthetic benefits to the shoe. The upper may include a mesh layer, as described above with respect to the midfoot webbing. The upper may also include a material in the forefoot region for added stability, e.g., thermoplastic polyurethane (TPU). The upper may be provided with an opening or break in the border stitching of the upper to let the straps through, as shown by 24 in FIG. 8. The upper may include a lining, for example a Nylex lining, shown as 25 in FIG. 8. The upper may include additional supportive polymeric layers, e.g., component 41 in FIG. 2, positing on top of the described mesh layer and/or Nylex linings of the upper.

Sidewalls: The shoe is provided with sidewalls designed to abut or encompass the ankle bone. The sidewalls are made of a substantially rigid material that provides sufficient deformation ability, e.g., mesh reinforced with leather or something with similar stiffness and give. The sidewalls provide robust protection against potential injuries by reducing or preventing ankle inversion. In preferred embodiments, the height of the sidewalls is sufficient to ensure that the ankle bone is partially or fully covered by the sides of the shoe. The height of the sidewalls may be changed based on the shoe size and type, with sidewall height corresponding to what would be understood in the art as low-top, mid-top, and high-top embodiments of the shoe. For example, the shoe embodiments depicted in FIGS. 1, 2, 7, 8, and 15 generally correspond to a high-top shoe. Other sidewall heights can be used without departing from the overall inventive aspects of the shoe embodiments disclosed herein.

Heel Counters: In some embodiments, the shoe is provided with one or more heel counters that provide additional stability and functional benefits. In one embodiment, the shoe is provided with an internal heel counter or an external heel counter. In another embodiment, two or more heel counters are provided, with at least one heel counter located internally and one externally (although these heel counters may in some instances be thought of as acting together as a single heel counter).

The internal heel counter is constructed of a material such as softer plastic that is relatively less rigid as compared to the outer heel counter. The internal heel counter is provided such that it wraps around the back and sides the ankle. In some embodiments the internal heel counter does not go under the heel cup of the insole, said heel cup described further below.

The internal heel counter may be positioned to substantially cup or cover the back of the wearer's ankle, e.g., as shown by the internal heel counter 17 (outline in dashed-line) in FIG. 8. Such an internal heel counter may work in cooperation with an external heel counter to provide structural support and stabilization to the shoe and to the ankle within the shoe. The heel counters may form part of certain aspects of the "360-degree lockdown" effect described herein. The heel counters provide the benefit of (contributing to) keeping the heel substantially locked in place, and giving the feeling of greater connection to the shoe and therefore control over the shoe.

Figure 15:
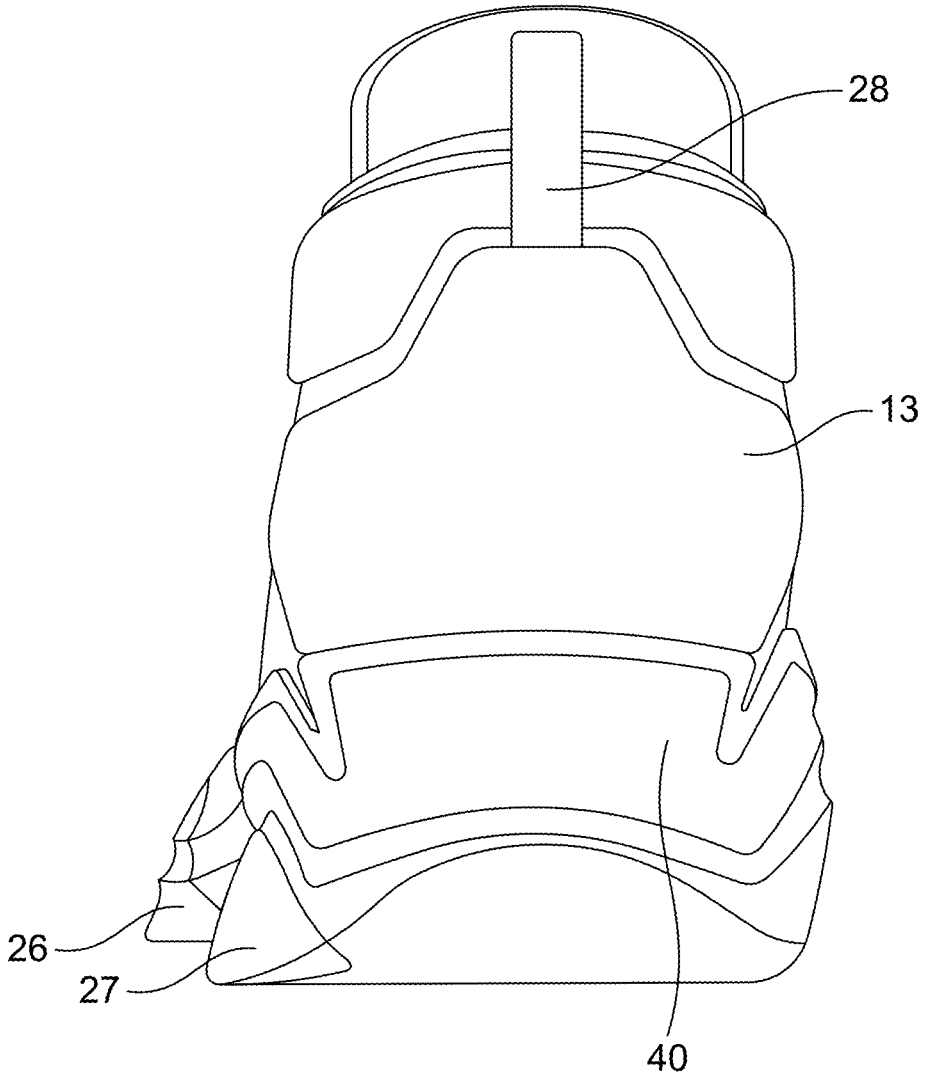
FIG. 15 shows a view of the rear of one embodiment of a shoe consistent with the present disclosure.
Figure 20:
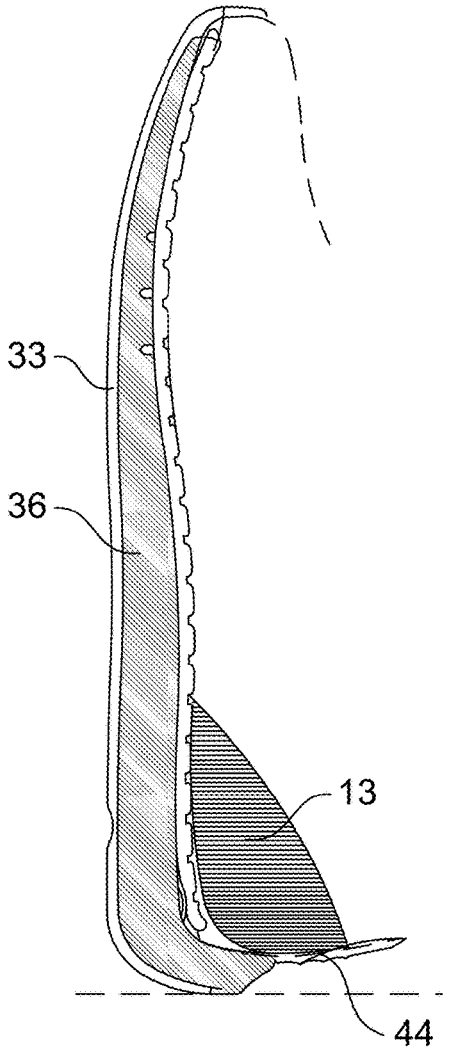
FIG. 20 shows a cross-sectional lateral side view of the outsole, midsole, and internal heel counter of an embodiment consistent with the present disclosure.
Figure 21:
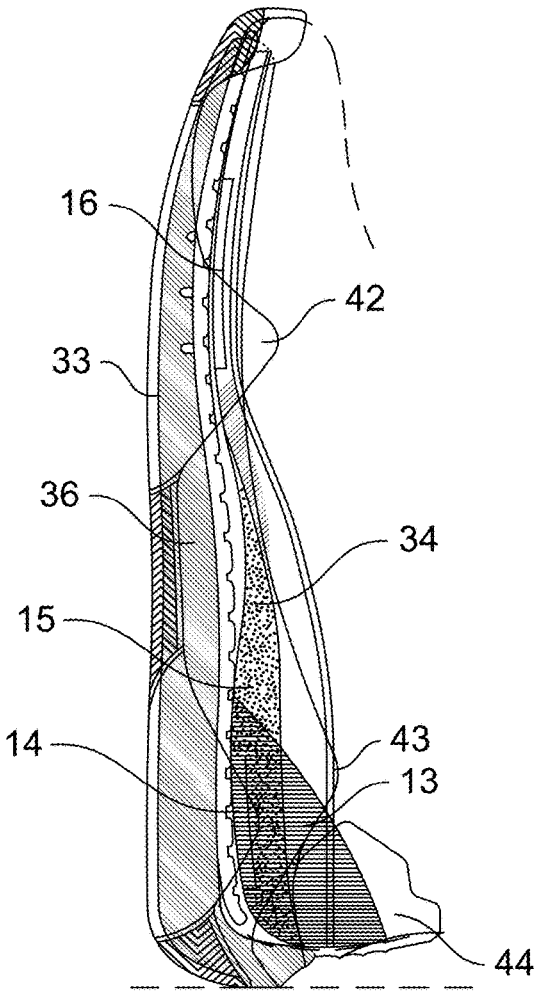
FIG. 21 shows a cross-sectional lateral side view of a shoe, including outsole, midsole, insole, heel counters, and other components, consistent with the present disclosure.

The external heel counter is typically constructed from a harder material as compared to the internal heel counter. In some embodiments, the external heel counter may comprise a rigid exo-skeleton that provides stability to the back of the user's heel and extends upward through the Achilles tendon. Exemplary heel counters are shown in FIGS. 1-2 and FIGS. 15, wherein an external heel counter 13 is shown (FIGS. 1-2 and 15), that may work in cooperation with the internal heel counter 17 shown in FIG. 8 (the outline of which is shown with a dashed-line). An especially preferred embodiment is shown in FIGS. 20-21, wherein the internal heel counter 13 and external heel counter 44 substantially overlap; this allows the internal and external heel counters to work in conjunction to position and support the heel and ankle, as part of one aspect of the 360-degree lockdown effect described herein.

The external heel counter may be positioned to roughly cover the back of the ankle of the wearer, extending upward starting roughly at or below the insertional point of the Achilles tendon, offering protection and support to the Achilles tendon and related ligament structures in the posterior of the ankle and lower leg. In a preferred embodiment, as shown in FIG. 1, the external heel counter 13 is shaped such that it has a lateral expanse that surrounds the back of the wearer's ankle, and a vertical expanse that extends upwards towards a back seam of the shoe, wherein the external heel counter may engage with or help provide support to a webbing. Such webbing (see, e.g., webbing 28 in FIG. 15) may extend substantially vertically from the back of the shoe along the back seam of the shoe, and the webbing may be provided with a loop at the end (see, e.g., webbing loop 29 in FIG. 1) for use as a finger loop to help with putting on and taking off the shoe or for hanging up the shoe.

Insole Features: In some embodiments, the shoe is provided with an insole disposed within the shoe and above the outside. In some embodiments, the insole features a deep heel cup. In such embodiments, the heel cup may be shaped and provided with dimensions such that it rises to all sides of the heel—i.e., the front of the heel cup is contiguous with the midsole portion of the insole and provides arch support, the sides of the heel cup extend up the sides of the ball of the heel to provide support to the back, medial, and lateral portions of the heel, extending up to the inner heel counter.

The deep heel cup may form a component of the 360-degree lockdown, such that the wearer's heel and ankle is supported from the bottom (a form of stabilization and lockdown) and also positioned optimally within the ankle-bracing portion of the shoe that includes the straps. The deep heel cup may also extend up to and be co-terminal with the inner heel counter and structurally serve to connect the heel to the base of the shoe and provide stability and control throughout the ball of the heel. In preferred aspects of the present invention, the deep heel cup works structurally in cooperation with the heel counter and straps, and further optionally in cooperation with the midfoot webbing and outriggers, to provide foot and ankle lockdown from all relevant angles to position and protect the ankle ligaments that have been described herein above, and provide greater control over the shoe.

In the above embodiments, the shoe may be further provided with a firm stabilizing shank from the heel through the arch of the foot to provide rigidity in the base of the shoe and provide control and energy return. Such a stabilizing shank in shown in FIG. 10, wherein the shank 15 forms part of the deep heel cup of the insole and extends forward toward the midfoot region. The shank portion of the heel cup may be constructed of a harder material than the surrounding materials, e.g., of ethylene-vinyl acetate (EVA), TPU, or carbon. The heel cup may be constructed of molded foam to cup the ankle, which extends out around the ankle bone and then tapers back in towards the wearer's foot. In a preferred embodiment, the stabilizing shank (e.g., shank 15 in FIG. 10) is positioned on the bottom of the insole, i.e., not in contact with a wearer's foot.

In some preferred embodiments, the deep heel cup of the insole is preferably provided with a crash pad of soft foam material to provide cushion for base of heel. The crash pad may be surrounded by the stabilizing shank, a benefit of which is to mitigate or relieve pressure on the base of the heel to potentially help with alleviating or mitigating symptoms of foot ailments such as plantar fasciitis. The relatively high arch support of the insole's midfoot portion (shown, for example, in FIG. 12, which shows the high arch support of the insole 34) and the forward portion of the heel cup serves to position the heel and push the heel down into the heel cup, which is accomplished by the shank, with the crash pad serving to cushion and position the ball of the heel. Such a crash pad is exemplified in FIG. 10, which shows the crash pad 14 within and surrounded by the rest of the insole and positioned within the deep heel cup (e.g., heel cup 17 shown in FIG. 11). FIG. 11 also shows the significant arch support in the midfoot region on the medial side of the insole, which is a preferred feature of the insole of the present embodiment. The crash pad within a hard shank within the deep heel cup forms a component of one embodiment of the 360-degree lockdown described herein.

In such embodiments, the crash pad is made by cutting out of the shank. The crash pad may be attached to the material of the whole insole. The pad and insole may be perforated for breathability. The insole may optionally be constructed of two or more materials. In some embodiment, the insole and crash pad is constructed of memory foam positioned on top of EVA, with a low friction liner on top of the memory foam. The bounce pad may provide for higher shock absorption, and work in cooperation with the insole to provide rebound for the forefoot. In a further optional aspect, the heel counter may overlap with the insole of the shoe for added support.

Figure 10:
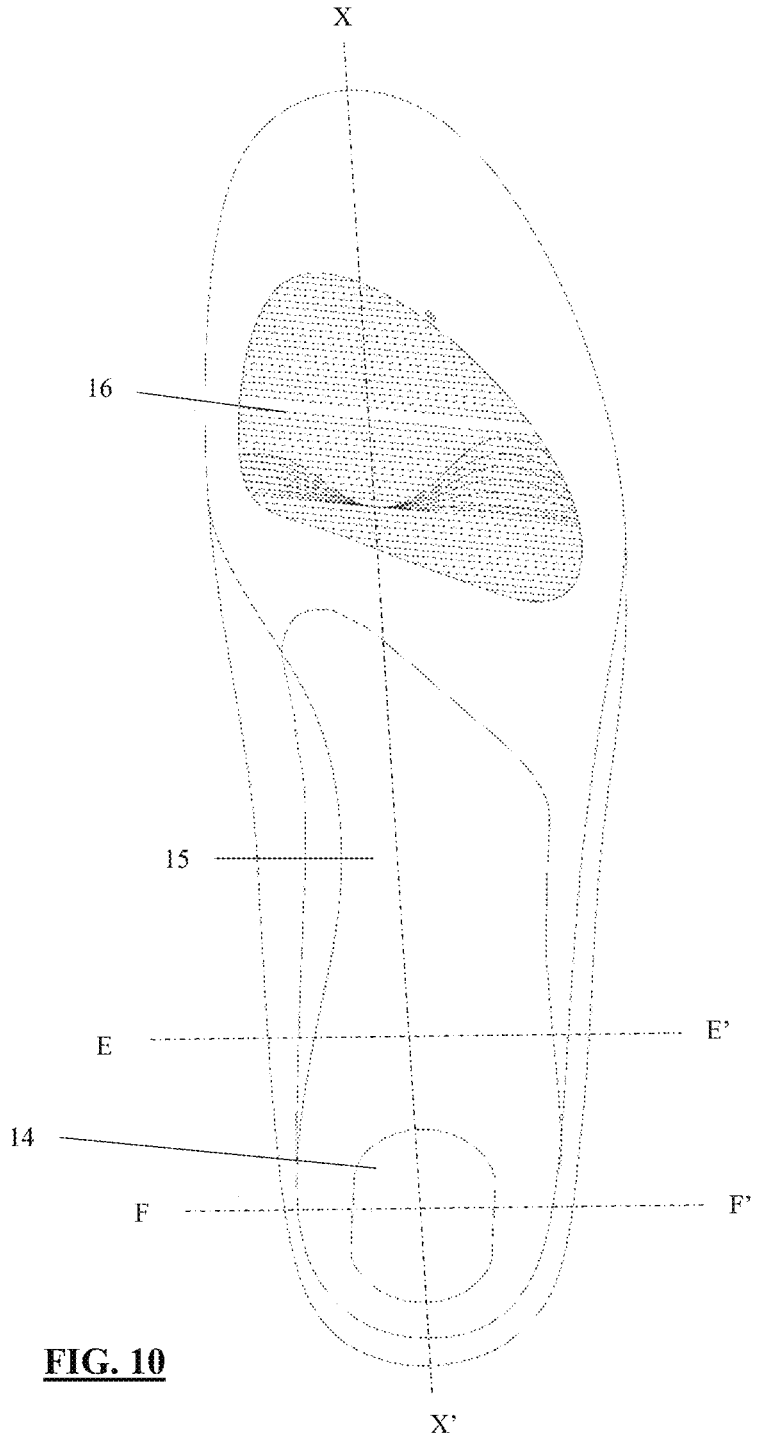
FIG. 10 shows a bottom or plan view of an insole consistent with the present disclosure.
Figure 11:
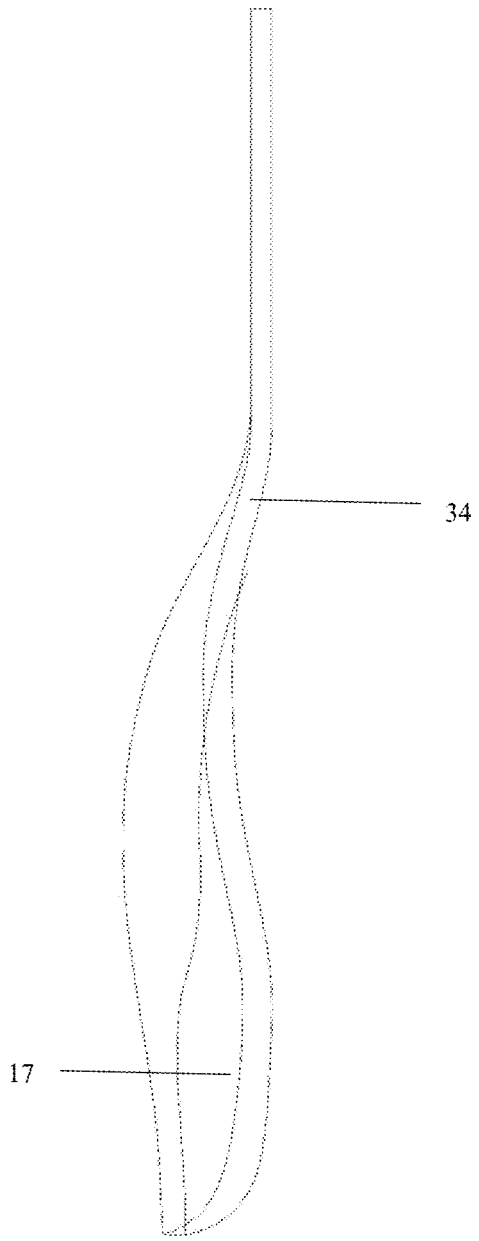
FIG. 11 shows a medial side sectional view of an insole consistent with the present disclosure.

The insole may further be provided with a bounce pad on the ball of foot, made (for example) of a high-density foam or similar polymer, to create more responsiveness and extra ground-foot feedback at the ball of the foot, as shown in FIG. 10, wherein the bounce pad is marked as component 16.

Figure 12:
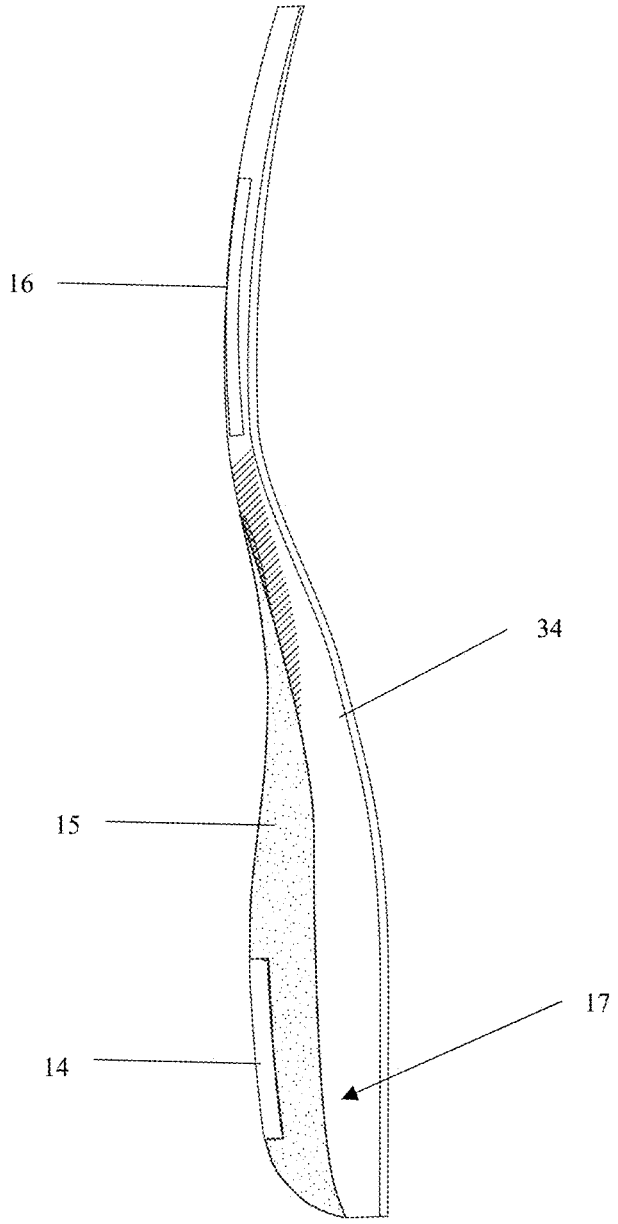
FIG. 12 shows a lateral side sectional view of an insole consistent with the present disclosure.

FIG. 12 shows a lateral perspective/sectional view of one embodiment of the above-described insole, viewed from the lateral outside of the insole, with a transparency view through to the insole components disposed along the line X-X' of FIG. 10. In the perspective view of FIG. 12, there can be seen a lateral view of the crash pad 14, the shank 15, the bounce pad 16, and the overall deep heel cup 17, wherein the relative exemplary depth of the heel cup can be clearly seen.

Figure 13:
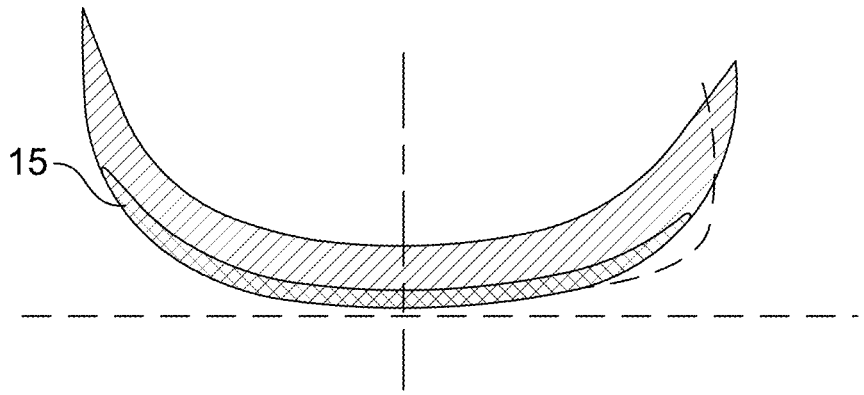
FIG. 13 shows a cross-sectional view of a portion of the insole of FIG. 10, viewed along the line E-E' of FIG. 10.
Figure 14:
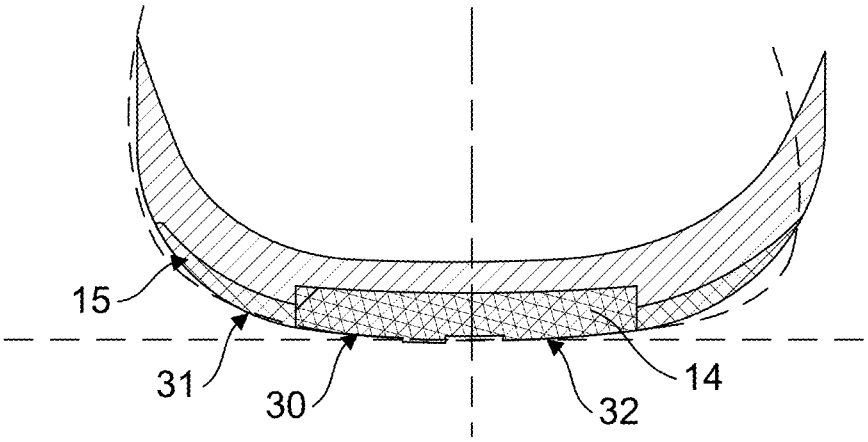
FIG. 14 shows a cross-sectional view of a portion of the insole of FIG. 10, viewed along the line F-F' of FIG. 10.

FIGS. 13 and 14 show further perspective views of the embodiment depicted in FIG. 10, wherein FIG. 13 is a lateral view along the line E-E' from FIG. 10, and FIG. 14 is a lateral view along the line F-F' of FIG. 10. These perspective views help illustrate preferred cross-sections of certain embodiments of the insole as described, and show the lateral cross-sectional view of a preferred depth of the heel cup that provides support for the ankle and positions it within the straps. FIGS. 13 and 14 show the hard shank 15, and FIG. 14 shows the crash pad 14 positioned within the deep heel cup along the line F-F' of FIG. 10. FIG. 14 also shows cross-sectional widths of the insole at position 30 (width of the crash pad, which may be between 0.1 and 1 cm, preferably between 0.2 and 0.6 cm, and more preferably around 0.4 cm), at position 31 (width of the hard shank at the depicted location, which may be between 0.05 and 0.5 cm, preferably between 0.1 and 0.3 cm, and more preferably around 0.2 cm) and at position 32 (width of the overall insole at the depicted location, which may be between 0.3 and 1.5 cm, preferably between 0.4 and 0.9 cm, and more preferably around 0.7 cm).

Outsole and Outriggers: The shoe is provided with an outsole. In some embodiments, the shoe is provided with at least two lateral support outriggers. The outriggers may be disposed along the outside of the shoe and/or integral with the shoe, on either the outer surface of the sole or outer surface of the sidewall adjacent to the sole above the bottom surface of the bottom component. In preferred embodiments, the outriggers are located on the outsole of the shoe. Such outriggers are shown, for example, as 26 and 27 in FIGS. 1 and 15.

The outriggers are of sufficient dimensions to reduce or prevent ankle inversion stresses of a foot within the shoe. Preferably one of the lateral outriggers is disposed in a region approximately adjacent to where the head of the 5th metatarsal of a foot within the shoe would be located, and a second of the lateral support outriggers is disposed adjacent to the anterior heel, the lateral support outriggers preferably each having a base portion which projects laterally outward from the shoe at a distance that, in some embodiments, may be approximately ¼ to ¾ inches. The outriggers serve to indirectly support and protect the wearer's ankle by providing a wider surface area to the outsole and inhibiting some part of the range of motion of the foot and ankle, thereby inhibiting or reducing the torsional motion of the foot and ankle that leads to ankle inversion, and increasing the leverage of the shoe.

In some embodiments, the sole may be manufactured by a single-mold, two-step process that makes the outrigger and the rest of the rubber outsole. That rubber outsole is then attached to the rest of the shoe. In some embodiments, there is no substantial overlap between the outrigger and anything other than the outsole and/or midsole, so as to enhance reinforcement and prevent delamination.

Figure 19:
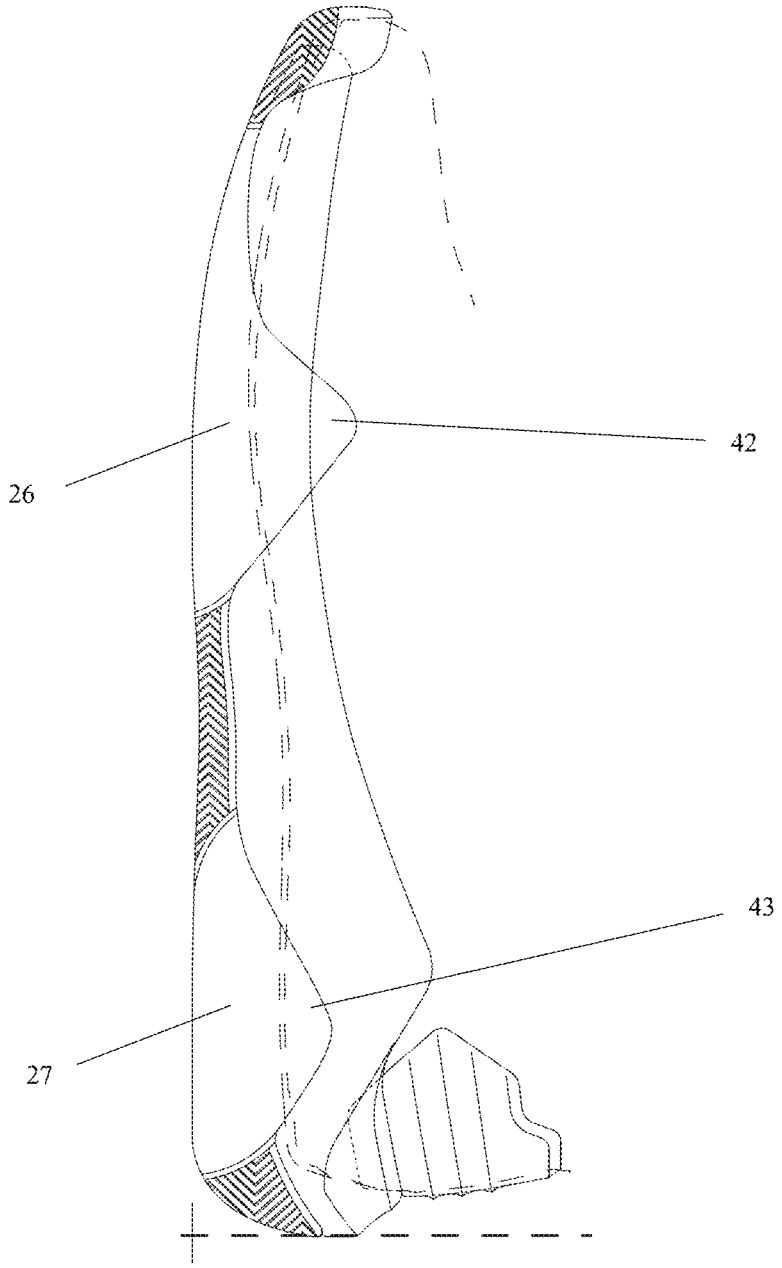
FIG. 19 shows a lateral side view of the outsole, midsole, and external heel counter of an embodiment consistent with the present disclosure.

In preferred embodiment, the vertical expanse of the outrigger forms a peak in contact with the shoe upper. This is seen, for example, in FIG. 19, which is a view of the lateral portion of the outsole showing a peak 42 of the outrigger 26 and a peak 43 of the outrigger 27, in contact with the Strobel and/or upper of the shoe. Overlap of the outrigger with the upper, through one or more peaks, creates a reinforced portion of the upper to add additional lateral support. In an alternate embodiment, the front outrigger may be split into two peaks, and optionally may also include one or more external lateral flex-groove on the midsole. For example, this could be a combination of flex grooves in the midsole, e.g., 2 or more flex grooves, and an external lateral flex-groove with twin peaks extending laterally on one or more of the outsole outriggers.

In preferred embodiments, the outriggers comprise lateral wedges that are of similar hardness or harder than the remaining rubber bottom unit of the outsole and are rounded to avoid interference in contact sports. The outriggers are constructed by building them up the sidewall of the upper to provide additional lateral support. In one aspect, the forefoot outrigger has a wall above that goes on and above the upper of the shoe and is positioned substantially proximal to the 5th metatarsal of the wearer's foot.

Figure 16:
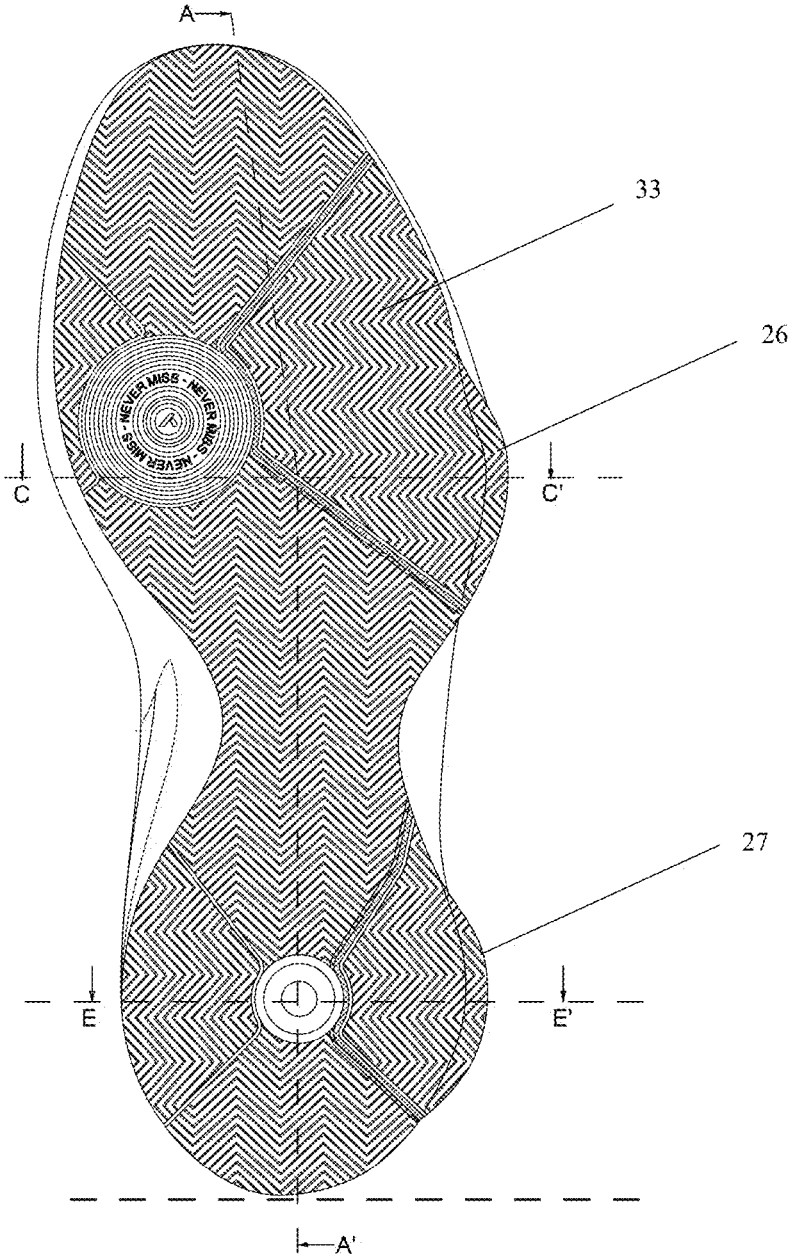
FIG. 16 shows an underside view of a shoe consistent with the present disclosure, showing portions of the outsole and outriggers.
Figure 17:
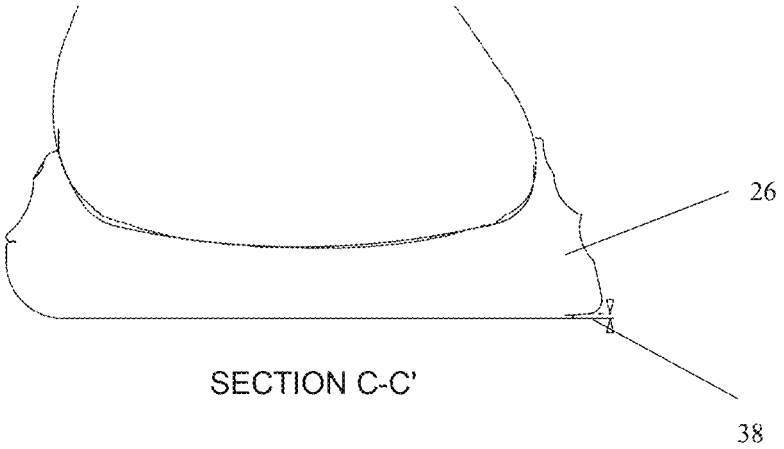
FIG. 17 shows a cross-sectional view of a portion of the shoe and outsole of FIG. 16, viewed along the line C-C' of FIG. 16.
Figure 18:
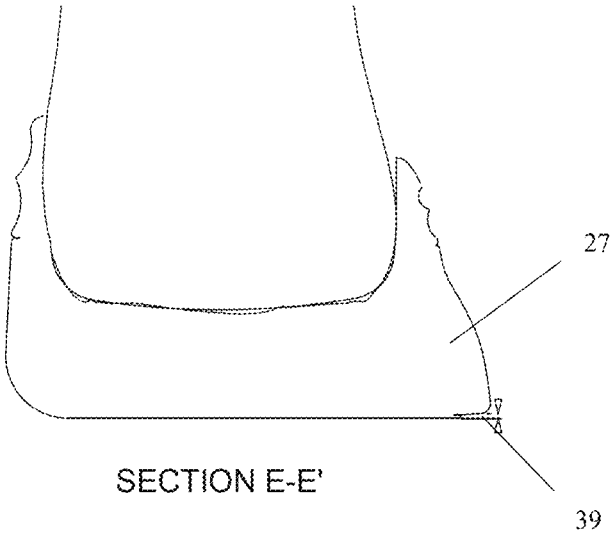
FIG. 18 shows a cross-sectional view of a portion of the shoe and outsole of FIG. 16, viewed along the line E-E' of FIG. 16.

With reference to FIG. 16, there is shown a bottom view of the sole of the shoe, with the outline of the outriggers 26, 27 depicted. In such embodiments, the outriggers may be contiguous with the sole 33 of the shoe. In alternate embodiments, the outriggers may be separated or outlined on the outside by means of a color dam or similar delineating portion. The outriggers may preferably be co-molded with the outsole. FIGS. 17 and 18 show cross-sectional views of the outsole and outriggers of FIG. 16, with FIG. 17 depicting the cross-section along line C-C' of FIG. 16, and FIG. 18 depicting the cross-section along line E-E' of FIG. 16. As can be seen in FIGS. 16 and 17. The outsole may, from a cross-sectional perspective, have two or more layers, with a harder rubber layer surrounding an inner layer that may comprise EVA foam or similar material. The outriggers project outwards laterally off of the outsole and/or sidewalls of the shoe.

Figure 22:
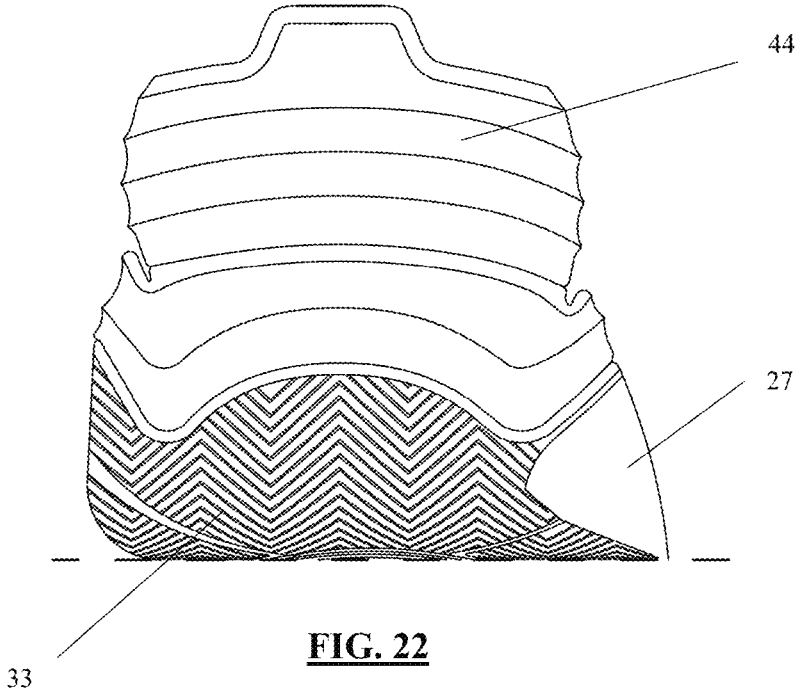
FIG. 22 shows a rear view of the exterior of a right-foot shoe (without depicting the upper) consistent with the present disclosure.

The outsole may also be provided with intrinsic cushioning and/or bounce-back areas, for example portion 35 in FIG. 16. The outsole may, in some embodiments, also be provided with an external heel support, e.g., portion 40 in FIGS. 1, 2, and 15, that serves to support and protect the base and back of the ankle. The external heel support portion may work in cooperation with the internal heel counter (and thus also with the external heel counter) to support, protect, and position the ankle within the shoe for engagement with the straps. However, in more preferred embodiments, such as disclosed in FIGS. 20-22, the external heel support portion is substantially smaller (in a vertical direction) as compared to the embodiments in FIGS. 1, 2, and 15. Thus, in the preferred embodiments in FIGS. 20-22, there is more substantial overlap between the internal and external heel counters (i.e., internal heel counter 13 and external heel counter 44 in FIGS. 20-21) to allow for superior support and positioning for the heel and ankle. In such embodiments, the outsole and midsole may wrap around the back of the heel (e.g., as shown in FIG. 21 showing the outsole 33 and midsole 36; and FIG. 22 depicting the outsole 33) and the outsole and/or midsole may be substantially co-terminal with (or be closely proximate to) the bottom extent of the external heel counter 44, with the internal heel counter 13 positioned under and covering up the portions of the external heel counter and midsole/outsole that are proximate to one another, thereby providing substantially unbroken or continuous support up and through the back of the heel and ankle.

Turning specifically to FIG. 21, there is shown a preferred embodiment of the positioning of the insole 34 (comprising a crash pad 14, shank 15, and bounce pad 16) with a deep heel cup, in relation to the internal heel counter 13, external heel counter 44, outsole 33, and midsole 36. FIG. 21 also depicts the peaks 42 and 43 of the front and back outrigger, respectively, and shows how those peaks would be potentially positioned on the shoe upper.

In some embodiments the outrigger is contiguous with the outsole and/or midsole of the shoe, proximate to the Strobel, wherein any extension from the outline of the Strobel is considered an outrigger. Such outrigger may be preferably co-formed with the sole. In these and other such embodiments, the outrigger starts at an elevation off of the foot bed, between 0.1 and 1 mm off the foot bed, preferably between 0.3 and 0.7 mm off the foot bed, and most preferably at 0.5 mm off the foot bed.

In some embodiments the outrigger may angle up to 0.8 mm, and then be provided with a rounding on the edge. Such rounding may be between 1 and 5 degrees, more preferably between 1 and 3 degree, and most preferably 2 degrees of rounding. Such rounding is shown as 38 in FIGS. 17 and 39 in FIG. 18, wherein the rounding angle in FIGS. 17 and 18 as shown in approximately 2-degrees. The angle of rounding provides support by smoothing out the motion of the foot during torsional inversion-type movements and avoiding sudden jerky displacement, while the outrigger's bulk provides the resistance to inversion movement that protects the foot and ankle.

The lateral outrigger supports (e.g., 26, 27) may be integrally molded to the outsole of the shoe. In some embodiments the lateral outrigger supports 26, 27 can be made of a rubber material that is softer and has a lower hardness than the material of the sole. This may serve to provide a greater cushioning effect for the shoe when the wearer's foot takes off from and lands on the ground. However, in preferred embodiments, the lateral outrigger is harder than the midsole, and of similar hardness or harder than the outsole portions proximate to the outriggers.

For example, in one embodiment, the outsole has a durometer hardness reading within the A range of hardness on a durometer scale. In such embodiments, the outsole and outriggers may have a hardness of 50 A to 75 A, more preferably 50 A to 60 A, and more preferably around 55 A. The midsole may have a hardness range from 35 C to 70 C, more preferably 40 C to 60 C. The relatively harder material of the lateral outrigger supports 26, 27 provides greater resistance to deformation and greater support and stability to the foot. In some embodiments, this can contribute to the 360-degree lockdown effect.

As described herein, one embodiment of the 360-degree lockdown effect is achieved through a combination of some or all of the components described herein. For example, the 360-degree lockdown effect is achieved through one or more of the following: a deep heel cup as described above that supports, stabilizes, and positions the ankle within the shoe; the internal and external heel counters described above serve to brace, support, and protect the ankle within the shoe; the midfoot webbing stabilizes the foot within the shoe and positions the ankle for interacting with the bracing portions of the shoe; the straps support, protect, and prevent substantial displacement of the crucial ankle ligaments, the engagement of said straps being optimized through their positioning as described, in cooperation with the other supportive and bracing components; the heel channel and/or a loop on the tongue ensures optimal positing of the straps including with respect to the laces; the laces secure the shoe to the foot and work in cooperation with the other supportive and positioning components; the outriggers prevent excessive ankle inversion and thus prevent displacement of the ankle ligaments; the sidewalls of appropriate height and constructed of a sufficiently rigid material (e.g., mesh reinforced with leather or synthetic leather) on the lateral heel panel provides additional stability; and/or an external heel support portion may work in cooperation with the internal and/or external heel counters to protect, support, and position the ankle within the bracing components of the shoe.

Method of wearing: The present inventive disclosure includes a method of wearing a shoe consistent with the embodiments disclosed herein, wherein a user engages and secures the straps consistent with their positioning as described above with respect to the medial and lateral walls of the shoe, and laces up the shoe as would typically be done by a shoe wearer. Other components of the shoe (e.g., the back seam webbing 28 of FIG. 15 and the loop on the tongue) may be used to help the wearer don the shoe.

In some embodiments, the shoe is further provided with instructions on the first or second strap that may be step-by-step instructions for positioning and engaging the straps. In such embodiments, the instructions are written/positioned on the straps such that subsequent instructions on the portions of the straps become visible or are positioned in the wearer's line of sight as the wearer follows the prior instructions for donning the straps. Thus, for example, the first instruction (i.e., step 1) would be on the first portion of the first strap that engages with the upper of the shoe, and once the wearer performs step 1 the second instruction comes into view and directs the wearer to perform step 2, and so on.

Figure 23:
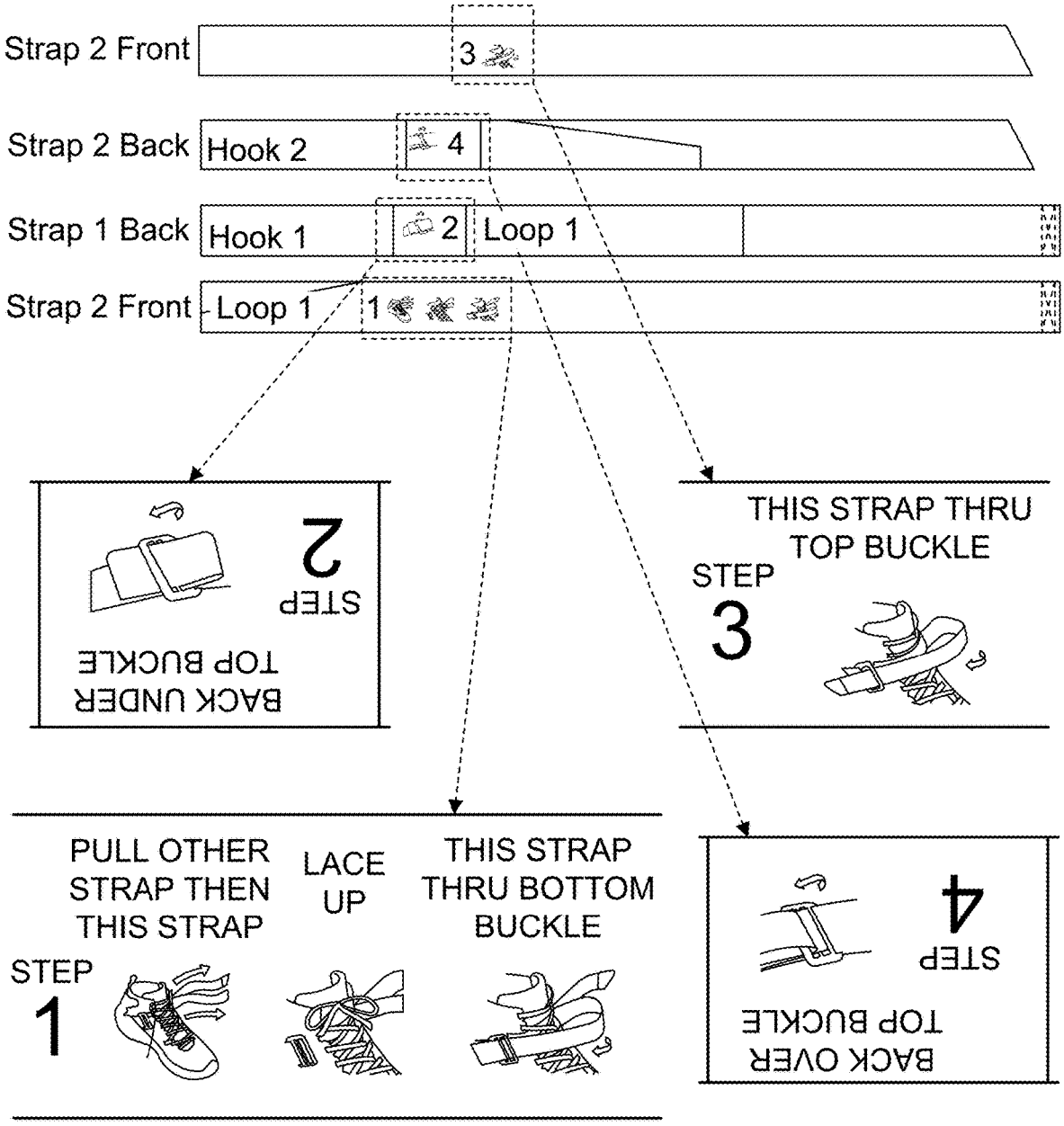
FIG. 23 shows an exemplary embodiment of a first strap and second strap consistent with an embodiment of the present invention, wherein the straps have instructions printed on relevant portions of their fronts and backs.

Turning to FIG. 23, there is shown an exemplary embodiment of the front and back of a first strap and second strap, wherein each strap has step-by-step instructions printed on it such that instructions for each step become visible or are called out upon performance of the preceding step. Thus, in FIG. 23, the bottom of the figure shows the front of the first strap such that the first step for wearing/putting on the shoe is visible on the first strap when not yet engaged with the strap closure mechanism. Once a wearer performs the first step (which, here, includes engagement of the first strap with the bottom of the buckle), the second step printed on the back of the first strap becomes visible once the wearer has performed the first step by folding the first strap through the buckle and back over itself. As so on.

In these or other embodiments, the buckle (that engages the straps) may be color-coded to assist the wearer in putting on the shoe and fastening it. For example, a blue and white buckle may be provided with one portion of the buckle blue and another portion in white, which may correspond to white and blue straps that engage with the corresponding portions of the buckle.

It will be appreciated by those skilled in the art that changes could be made to the embodiments described above without departing from the broad inventive concept thereof. It is understood, therefore, that this invention is not limited to the particular embodiments disclosed, but is intended to cover modifications within the spirit and scope of the present invention as defined by the present disclosure.

We claim:

1. A shoe, comprising:

an outsole;

an upper comprising a medial sidewall, a lateral sidewall, a strobel, and a back seam connecting the medial and lateral sidewalls;

a tongue disposed between the medial and lateral sidewalls;

laces disposed substantially between the medial and lateral sidewalls and above the tongue;

a first strap attached to the lateral sidewall of the shoe, wherein the first strap is positioned so as to angle upwards and pass within a heel channel directionally from the lateral sidewall to the medial sidewall of the shoe and emerge from an opening in the inner heel channel, then pass over the tongue and through a first slit in the lateral sidewall, emerging out of the first slit on the outside of the lateral sidewall and passing over the top of the laces, wherein said first strap is provided with an engagement means such that the first strap is capable of being placed in an engaged position comprising folding a first portion of the first strap over a second portion of the first strap;

a second strap attached to the medial sidewall of the shoe, wherein the second strap is positioned so as to angle upwards within the heel channel within the medial sidewall and emerge from an opening in the inner heel channel then pass over the tongue and through a second slit in the lateral sidewall, emerging out of the second slit on the outside of the lateral sidewall and passing over the top of the laces, wherein said second strap is provided with an engagement means such that the second strap is capable of being placed in an engaged position comprising folding a first portion of the second strap over a second portion of the second strap;

a first outrigger located on the lateral side of the shoe proximal to a forefoot region of the shoe; and a second outrigger located on the lateral side of the shoe proximal to a heel region of the shoe.

2. The shoe of claim 1, further comprising a midfoot webbing located substantially proximal to the midfoot portion of the shoe, said webbing extending upward through the upper and emerging from an opening in the lateral sidewall of the shoe, said webbing configured to as to be capable of engaging with the laces.

3. The shoe of claim 2, wherein the midfoot webbing is attached to the Strobel.

4. The shoe of claim 2 wherein the midfoot webbing is provided with a loop at its upper end, said loop being capable of engagement with the laces.

5. The shoe of claim 1, further comprising an inner heel counter.

6. The shoe of claim 1, further comprising an outer heel counter.

7. The shoe of claim 5, further comprising an insole comprising a heel cup that is shaped so as to rise to the sides of a wearer's heel when positioned within the shoe.

8. The shoe of claim 7, wherein the upper rear portion of the heel cup overlaps with the inner heel counter.

9. The shoe of claim 7, wherein the insole further comprises a stabilizing shank extending from a portion of the insole positioned below heel of a wearer's foot to the portion of the insole positioned below the arch of a wearer's foot.

10. The shoe of claim 7 further comprising a crash pad disposed within the stabilizing shank of the insole and positioned proximal to the ball of a wearer's heel.

11. The shoe of claim 10, further comprising a bounce pad on the insole positioned proximal to the ball of a wearer's foot.

12. The shoe of claim 1, wherein the first outrigger extends laterally outwards from the lateral side of the shoe at a position approximately proximal to the fifth metatarsal of a wearer's foot, and wherein the second outrigger extends laterally outwards from the lateral side of the shoe at a position approximately proximal to the heel of a wearer's foot.

13. The shoe of claim 12, wherein the first and second outriggers are located on the lateral side of the outsole.

14. The shoe of claim 13, wherein the first and second outriggers as disposed at an elevation off of the footbed of the shoe, wherein the bottom side of said outriggers angle upwards laterally away from the shoe, said outriggers being rounded at the base of the lateral sides of the outriggers.

15. The shoe of claim 1, further comprising an inner heel counter and an outer heel counter, wherein the inner heel counter and outer heel counter overlap.

16. The shoe of claim 15, further comprising an insole comprising a deep heel cup that is shaped so as to rise to the sides of a wearer's heel when positioned within the shoe, wherein an upper rear portion of the deep heel cup overlaps with a bottom portion of the inner heel counter, and an upper portion of the inner heel counter overlaps with a bottom portion of the outer heel counter.

17. The shoe of claim 16, further comprising an external heel support located on the rear portion of the outsole and positioned approximately below and substantially co-terminal with the bottom portion of the outer heel counter.

18. The shoe of claim 6, wherein the outer heel counter comprises a lateral expanse that surrounds a portion of the back of a wearer's foot, and a vertical expanse that extends upwards along a back seam of the shoe, wherein the outer heel counter engages with a webbing disposed substantially vertically along the back seam of the shoe, said webbing provided with a loop at its end.

19. A shoe, comprising:

an outsole;

an upper comprising a medial sidewall and a lateral sidewall;

a tongue disposed between the medial and lateral sidewalls;

laces disposed substantially between the medial and lateral sidewalls and above the tongue;

a first strap attached to the lateral sidewall of the shoe, wherein the first strap is positioned so as to pass directionally behind a wearer's foot from the lateral sidewall to the medial sidewall of the shoe and emerge from an opening in the upper, then pass over the wearer's foot and through a slit in the lateral sidewall, emerging out of the slit on the outside of the lateral sidewall and passing over the top of the laces, wherein said first strap is capable of being secured in place on the top surface of the shoe above the wearer's foot;

a second strap attached to the medial sidewall of the shoe, wherein the second strap is positioned so as to angle upwards within the medial sidewall and emerge from an opening in the medial sidewall and then pass over the tongue and the lateral sidewall, emerging out of the lateral sidewall and passing over the top of the laces, wherein said second strap is capable of being secured above the wearer's foot on the top surface of the shoe, wherein a terminal portion of the second strap is secured at least partially above a terminal portion of the first strap;

a first outrigger located on the lateral side of the shoe proximal to a forefoot region of the shoe, said first outrigger comprising a peak extending vertically above the first outrigger along the upper; and a second outrigger located on the lateral side of the shoe proximal to a heel region of the shoe, said second outrigger comprising a peak extending vertically above the second outrigger along the upper.

20. An athletic shoe, comprising:

an outsole;

an upper comprising a medial sidewall, a lateral sidewall, a strobel, and a back seam connecting the medial and lateral sidewalls;

a tongue disposed between the medial and lateral sidewalls;

a first strap attached to the lateral sidewall of the shoe, wherein the first strap is positioned so as to angle upwards and pass within a heel channel directionally from the lateral sidewall to the medial sidewall of the shoe and emerge from an opening in the inner heel channel, then pass over the tongue and through a first slit in the lateral sidewall, emerging out of the first slit on the outside of the lateral sidewall, wherein said first strap is provided with an engagement means such that the first strap is capable of being placed in an engaged position comprising folding a first portion of the first strap over a second portion of the first strap;

a second strap attached to the medial sidewall of the shoe, wherein the second strap is positioned so as to angle upwards within the heel channel within the medial sidewall and emerge from an opening in the inner heel channel then pass over the tongue and through a second slit in the lateral sidewall, emerging out of the second slit on the outside of the lateral sidewall, wherein said second strap is provided with an engagement means such that the second strap is capable of being placed in an engaged position comprising folding a first portion of the second strap over a second portion of the second strap;

a first outrigger located on the lateral side of the shoe proximal to a forefoot region of the shoe; and a second outrigger located on the lateral side of the shoe proximal to a heel region of the shoe.

* * * * *